US009261250B2

(12) United States Patent
Champagne

(10) Patent No.: US 9,261,250 B2
(45) Date of Patent: Feb. 16, 2016

(54) ILLUMINATED DISPLAY UNIT HAVING SUSPENSION CLAMPS

(71) Applicant: VDP, Saint Denis (FR)

(72) Inventor: Benjamin Champagne, Shenzhen (CN)

(73) Assignee: VDP, Saint Denis (FR)

( * ) Notice: Subject to any disclaimer, the term of this patent is extended or adjusted under 35 U.S.C. 154(b) by 0 days.

(21) Appl. No.: 14/404,597

(22) PCT Filed: May 30, 2013

(86) PCT No.: PCT/EP2013/061187

§ 371 (c)(1),
(2) Date: Nov. 28, 2014

(87) PCT Pub. No.: WO2013/178747

PCT Pub. Date: Dec. 5, 2013

(65) Prior Publication Data

US 2015/0192262 A1 Jul. 9, 2015

(30) Foreign Application Priority Data

May 30, 2012 (FR) ..... 12 54999
May 30, 2012 (FR) ..... 12 55002
Oct. 12, 2012 (FR) ..... 12 59627

(51) Int. Cl.
*G09F 7/22* (2006.01)
*F21S 8/06* (2006.01)
(Continued)

(52) U.S. Cl.
CPC ..... *F21S 8/061* (2013.01); *F21V 21/008* (2013.01); *F21V 21/096* (2013.01);
(Continued)

(58) Field of Classification Search
CPC ..... G09F 13/18; G09F 13/22; G09F 13/04; G09F 9/33
USPC ..... 40/546, 607.09, 617, 714, 544
See application file for complete search history.

(56) References Cited

U.S. PATENT DOCUMENTS 3,591,941 A * 7/1971 Jaffe, Jr. ..... 40/546
5,529,274 A * 6/1996 Anderson et al. ..... 248/329
(Continued)

FOREIGN PATENT DOCUMENTS

DE 199 31 285 A1 1/2001
DE 20 2011 000020 U1 4/2012
(Continued)

OTHER PUBLICATIONS

Search Report issued by EPO on Jun. 21, 2013 and the Written opinion in English language as issued by IB on Dec. 2, 2014.

*Primary Examiner* — Shin Kim
(74) *Attorney, Agent, or Firm* — Michael B. Fein; Eckert Seamans Cherin & Mellott, LLC

(57) ABSTRACT

The invention relates to an illuminated display assembly including at least one electrically conductive cable (14), at least two display panels (12) connected to one another via said at least one cable (14), each display panel (12) including light elements (18), and an electrical power source (16) which supplies electrical power to the light elements (18) of said at least two display panels (12) and which is located upstream from the display panels (12). Two consecutive display panels (12) define an upstream display panel (14) and a downstream display panel (14) relative to the electrical power source (16).

Each display panel (12) includes a transmission device (28) for transmitting electrical power through said panel (12), such that a given panel (12) is electrically connected to the electrical power source via the transmission device (28) of the upstream display panel (12).

21 Claims, 11 Drawing Sheets

(51) Int. Cl.

| | |
|---|---|
| ***G09F 13/18*** | (2006.01) |
| ***G09F 13/22*** | (2006.01) |
| ***F21V 21/008*** | (2006.01) |
| ***F21V 21/096*** | (2006.01) |
| ***F21V 23/00*** | (2015.01) |
| *G09F 7/18* | (2006.01) |

(52) U.S. Cl.
CPC ..... *F21V 23/001* (2013.01); *G09F 13/18* (2013.01); *G09F 13/22* (2013.01); *G09F 2007/186* (2013.01); *G09F 2013/222* (2013.01)

(56) References Cited

U.S. PATENT DOCUMENTS

| | | | | |
|---|---|---|---|---|
| 6,003,255 | A * | 12/1999 | Mahoney et al. | 40/611.05 |
| 6,305,109 | B1 * | 10/2001 | Lee | 40/546 |
| 7,086,190 | B2 * | 8/2006 | Voluckas | 40/617 |
| 7,089,694 | B2 * | 8/2006 | Allen | 40/607.04 |
| 7,895,784 | B1 * | 3/2011 | Clark et al. | 40/617 |
| 8,251,329 | B2 * | 8/2012 | Suciu et al. | 248/316.2 |
| 8,959,811 | B2 * | 2/2015 | Healy | 40/541 |
| 9,027,271 | B2 * | 5/2015 | Bronzoni | 40/617 |
| 2007/0193088 | A1 | 8/2007 | Lemberger et al. | |

FOREIGN PATENT DOCUMENTS

| | | | |
|---|---|---|---|
| EP | 2 249 442 | A1 | 11/2010 |
| FR | 2 731 332 | A1 | 9/1996 |
| FR | 2 945 385 | A1 | 11/2010 |
| JP | 2007-141735 | A | 6/2007 |
| JP | 2007-240567 | A | 9/2007 |

* cited by examiner

ILLUMINATED DISPLAY UNIT HAVING SUSPENSION CLAMPS

CROSS-REFERENCE TO RELATED APPLICATIONS

The application is a national stage of International Application No. PCT/EP2013/061187, filed May 30, 2013, which claims the benefit of French Patent Application Serial No. 12 55002, filed May 30, 2012, French Patent Application Serial No. 12 54999, filed May 30, 2012, and French Patent Application Serial No. 12 59627, filed Oct. 12, 2012, all of which are hereby incorporated by reference.

BACKGROUND OF THE INVENTION

The present invention relates to illuminated display units.

More particularly, according to a first aspect, the invention relates to an illuminated display unit comprising:

at least one electrically conductive cable, at least two display panels connected to one another via said at least one cable, each display panel including light elements, and an electrical power source which supplies electrical power to the light elements of said at least two display panels and which is located upstream from the display panels, two consecutive display panels defining an upstream display panel and a downstream display panel relative to the electrical power source.

The field of the invention is the display of documents using illuminated display panels, for example for business windows, which, in a known manner, improves the presentation of the documents in question and favors their reading by passersby.

For the proper operation of such systems, each of the panels must be supplied with electrical power, such that its light elements can light up.

Several technical solutions aiming to allow the supply of electrical energy to the panels from an electrical power source situated upstream from the panels have been considered.

One of these consists of suspending the panels of the unit above one another and fastening two electrically conductive cables to all of them in parallel between them.

The cables are then used to distribute the electrical power to each of the panels and evacuate the electrical power from the unit, as well as to suspend the unit from a support.

However, this solution is not fully satisfactory.

Indeed, this connection of all of the panels with two parallel cables prohibits the presence of panels with different widths in the unit, which makes such units relatively unsuitable.

One of the aims of the invention is therefore to propose an illuminated display unit that does not have these drawbacks.

SUMMARY OF THE INVENTION

To that end, the invention relates to an illuminated display unit of the aforementioned type, characterized in that each display panel includes a transmission device for transmitting electrical power through said panel such that a given panel is electrically connected to the electrical power source via the transmission device of the upstream display panel.

The illuminated display unit can also comprise one or more of the following technical features, considered alone or according to any technically possible combination(s):

each display panel comprises at least two electrically conductive clamps respectively capable of locking a cable to said display panel and respectively situated on one of the two opposite edges of the display panel;

the transmission device of each display panel comprises an electrically conductive track extending between the two clamps through which the electrical energy passes from one of said clamps to the other;

the unit is arranged vertically, each display panel being suspended from the upstream display panel using only one cable, the weight of a given display panel being supported by the upstream display panel;

at least two display panels suspended from one another each having a substantially rectangular general shape, said two display panels having respective widths different from one another;

each cable comprises two electrically conductive hammers respectively supported by one of the two ends of said cable;

the unit comprises at least one electrically conductive clamp, each clamp comprising a closed housing and a slot for inserting a hammer into the housing;

each hammer has an ovoid shape having a single axis of symmetry of revolution and each slot has a portion having dimensions substantially equal to those of the maximum section of said hammer along its axis of symmetry of revolution;

each panel comprises three plates, including one central plate around which the light elements are positioned as well as two secondary plates capable of being fastened to the central plate on either side of said central plate;

the illuminated display unit also comprises a plurality of substantially flat objects designed to be illuminated, each object being inserted between the central plate and one of the secondary plates of a lighted panel;

the illuminated display unit comprises at least two upstream display panels and at least one downstream display panel, the downstream display panel being connected to each of the two upstream display panels by at least one cable, the downstream display panel being electrically connected to the electrical power source via the transmission of the two upstream display panels;

the electrical power source has a positive polarity terminal and a negative polarity terminal, the downstream display panel being electrically connected to the positive polarity terminal of the electrical power source via the transmission device of one of the two upstream display panels, and being electrically connected to the negative polarity terminal of the electrical power source via the transmission device of the other of the two upstream panels;

the illuminated display unit comprises at least one upstream display panel and at least two downstream display panels, each downstream display panel being connected to the upstream display panel by at least one cable, the downstream display panels being electrically connected to the electrical power source via the transmission device of the upstream display panel;

each display panel comprises a section, and at least one electrically conductive clamp having an outer face in which a slot for receiving one of the at least one cable is formed, at least one of the clamps of one of the at least one display panel is housed in said display panel, the outer face of the clamp being substantially aligned with the section of the display panel, the slot being oriented toward the outside of the display panel and being accessible from the outside of the display panel.

According to a second aspect, independent of the first, the invention pertains to an illuminated display unit, comprising:

at least one electrically conductive cable, and at least one display panel, each display panel comprising a section, light elements and at least one electrically conductive clamp having an outer face in which a slot is formed for receiving one of the at least one cable, characterized in that at least one of the clamps of one of the at least one display panel is housed in said display panel, the outer face of the clamp being substantially aligned with the section of the display panel, the slot being oriented toward the outside of the display panel and being accessible from the outside of the display panel.

The illuminated display unit according to the first aspect of the invention and the illuminated display unit according to the second aspect of the invention may both have one or more of the following technical features, considered alone or according to any technically possible combination(s):

each clamp of each display panel is housed in the corresponding display panel, the outer face of each clamp being substantially aligned with the section of the corresponding display panel, the slot being oriented toward the outside of the display panel and being accessible from the outside of the display panel;

the or each display panel has a substantially rectangular shape, each display panel comprising eight clamps incorporated into the display panel and positioned in the display panel at a rate of two clamps per edge;

the illuminated display unit comprises at least one display panel in which the distances separating two clamps of a given edge are substantially equal to one another, preferably all equal to one another;

the or at least one of the clamps housed in the corresponding display panel has two oblique faces inclined relative to the outer face of the corresponding clamp and is received in a receiving housing with a complementary shape in the corresponding display panel, the vectors respectively normal to each of the oblique faces of said clamp being oriented toward the outside of the display panel, the clamp being immobilized in its housing by abutting cooperation of its oblique faces with inclined surfaces delimiting said housing;

each cable comprises two hammers respectively situated at both of the ends of said cable and capable of being inserted into the slots, each clamp comprising a central housing on which the corresponding slot emerges, the central housing being delimited toward the outer face by a bottom delimiting a concavity with a shape complementary to that of said hammers;

the slot comprises a circular portion emerging in the central housing, as well as a rectilinear longitudinal portion emerging in the circular portion, in the central housing and in the concavity;

each hammer has an ovoid shape having a single axis of symmetry of revolution with a maximum section taken along said axis of symmetry of revolution substantially equal to the diameter of the circular portion, each clamp comprises a guide surface arranged in the central housing and connecting the circular portion of the slot to the concavity, and said guide surface has a convex shape oriented toward the central housing, such that the movement of a hammer along said guide surface causes pivoting of the axis of symmetry of revolution of the hammer;

each panel has a generally rectangular shape and comprises a central plate and a front plate with substantially the same dimensions, and at least one of the display panels comprises irreversible securing means that irreversibly secure two consecutive edges of the front plate to the two corresponding edges of the central plate, and reversible securing means that reversibly secure the other two edges of the front plate to the corresponding two edges of the central plate;

the reversible securing means comprise magnets at least supported by the front plate and the central plate at their edges, and the irreversible securing means comprise adhesive strips supported at least by the front plate or the central plate along the corresponding edges;

at least one clamp comprises at least one lug secured to the clamp and extending from the clamp in a direction opposite the clamp.

According to a third aspect, independently of the first and second aspects, the invention relates to an illuminated display unit, comprising:

at least one electrically conductive cable, and at least one display panel, each display panel comprising light elements, at least one electrically conductive clamp fastened to said display panel and designed to cooperate with at least one of the at least one cable, and at least one link defining the position of the clamp along the cable and producing the connection of a clamp to a cable, characterized in that said at least one link is a pivot link.

The illuminated display unit according to the third aspect of the invention may comprise one or more of the following features, considered alone or according to any technically possible combination(s):

each link comprises a housing situated in the clamp, an electrically conductive hammer fastened to the end of the cable and engaged in said housing, as well as a bowed slot formed in the clamp in which the cable is engaged and slides for the rotation of the display panel in question relative to said cable;

the display panels are superimposed, each display panel supporting the immediately lower display panel via at least one cable, the weight of said immediately lower display panel being completely reacted by said display panel;

each display panel comprises four clamps and eight links, each clamp comprising two bowed slots and being comprised in two links each comprising one of the two bowed slots and respectively producing the link of the clamp to a cable for the suspension of said display panel from the immediately higher display panel and the connection of the clamp to a cable for the suspension of an immediately lower display panel from said display panel;

each display panel has two opposite edges, two of the clamps of each display panel being fastened on each of the opposite edges of said display panel;

the unit also comprises an electrical power source for powering the light elements of the display panels, the electrical power circulating from one display panel to another via the or each cable by the which the display panel(s) are suspended from one another;

the unit also comprises a support for suspending a first display panel via two cables, each of said two cables cooperating with two clamps of said first display panel for the suspension of said first display panel from the support;

the unit also comprises two pulleys connected to the support, each pulley comprising a slot in which one of said two cables is engaged and is capable of sliding to modify the incline of the first panel;

each pulley comprises a base and a stopper designed to cooperate with one another to immobilize the cable engaged in the slot of said pulley;

the housing of each clamp has a generally cylindrical shape and each clamp comprises a cap with dimensions complementary to the dimensions of said housing and capable of cooperating with said housing to close it off; and each display panel comprises three plates, including a central plate in which the light elements are positioned as well as two secondary plates capable of being fastened to the central plate.

BRIEF DESCRIPTION OF THE DRAWINGS

The invention will be better understood upon reading the following detailed description, done as an example and in reference to the appended Figures, in which.

DETAILED DESCRIPTION

Figure 1:
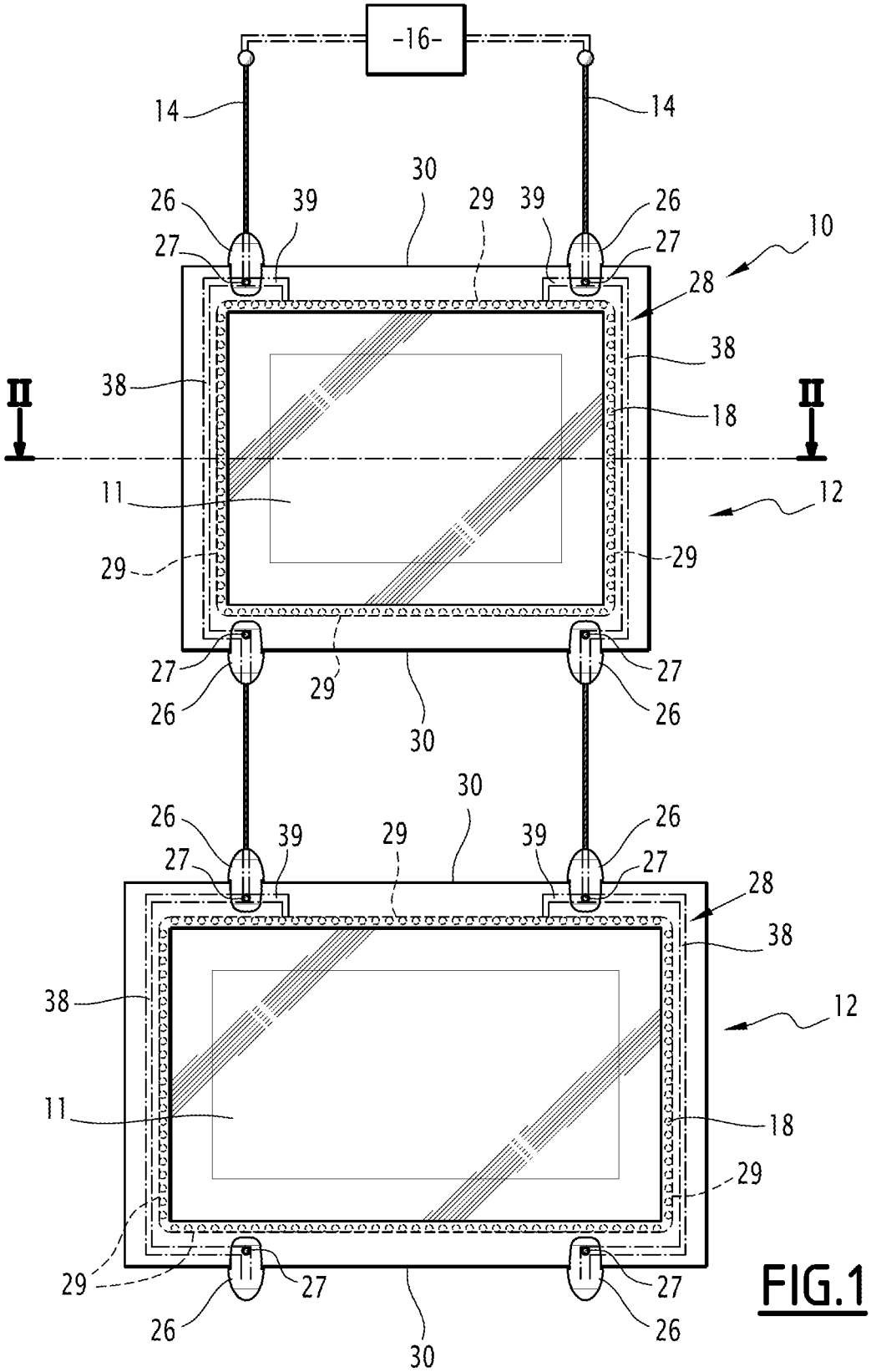
FIG. 1 is a diagrammatic illustration of an illuminated display unit according to a first embodiment of the invention, illustrating the first aspect of the invention.

FIGS. 1 to 5 illustrate a first embodiment of the invention.

In the following, two panels define an upstream panel and a downstream panel relative to a source comprised by the illuminated display unit according to the invention, the upstream panel being closer to the source than the downstream panel.

In reference to FIG. 1, the illuminated display unit 10 according to the invention, hereinafter referred to as the unit 10, is designed to provide the illuminated display of documents 11. It comprises at least two display panels 12, hereinafter referred to as panels 12, electrically conductive cables 14, and an electrical power source 16 designed to supply the panels 12 with electrical power.

In the example of FIG. 1, the unit 10 is positioned vertically and comprises an upstream panel 12 electrically connected to the source 16 and mechanically connected to a support (not shown) by two parallel cables 14, and a downstream panel 12 electrically and mechanically connected to the upstream panel 12 by two cables 14, which are also parallel.

Each panel 12 is capable of providing the illuminated display of one or more thin documents 11. Furthermore, each panel 12 is electrically connected to the source 16 via the upstream panels 12.

Each panel 12 is then additionally directly connected to an upstream panel 12 and a downstream panel 12. The connection of one panel 12 to another panel 12 is done via two cables 14 connecting nothing other than those two panels 12 to one another.

Figure 2:
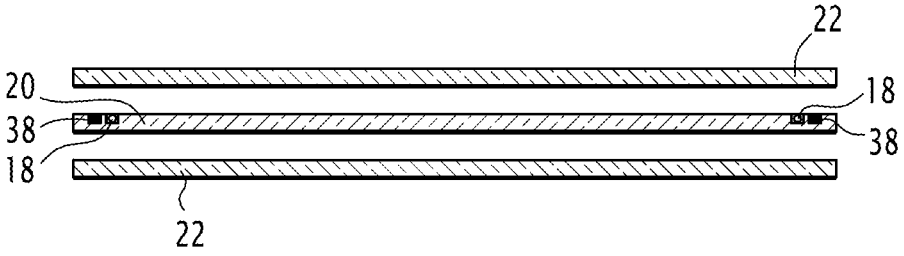
FIG. 2 is a top view of a panel of the illuminated display unit of FIG. 1.

In reference to FIGS. 1 and 2, each panel 12 comprises a plurality of light elements 18, a central plate 20 and two secondary plates 22 designed to be fastened to the central plate 20 on either side thereof. Furthermore, each panel 12 includes four clamps 26 each capable of cooperating with a single cable 14 and blocking the movement of the panel 12 relative to the cable 14, and a transmission device 28 for transmitting electrical power through the panel 12.

Each panel 12 also has at least two edges 30 opposite one another, said two opposite edges defining an upstream edge 30 and a downstream edge 30 relative to the source 16.

The light elements 18 are positioned on rectilinear strips 29 positioned in a rectangle, electrically connected to each other, oriented toward the center of the central plate 20 and positioned in an extruded slot formed on the perimeter of the central plate 20.

The strips 29 are for example made from polychlorinated biphenyl, or PCB, and are electrically connected to each other.

In the example of FIGS. 1 and 2, the light elements 18 are light-emitting diodes.

The central 20 and secondary 22 plates are made from a polymethyl methacrylate, or PMMA, and are simultaneously fastened to one another.

The central plate 20 has a surface treatment designed to send the light radiation from the elements 18 toward the secondary plates 22.

For the illuminated display of a document 11 by a panel 12, the document is inserted between the central plate 20 and one of the secondary plates 22, such that the fastening of the secondary plates 22 to the central plate 20 causes the document 11 to be maintained in position in the panel 12.

In the example of FIG. 1, the plates 20, 22 have substantially rectangular shapes.

Figure 3:
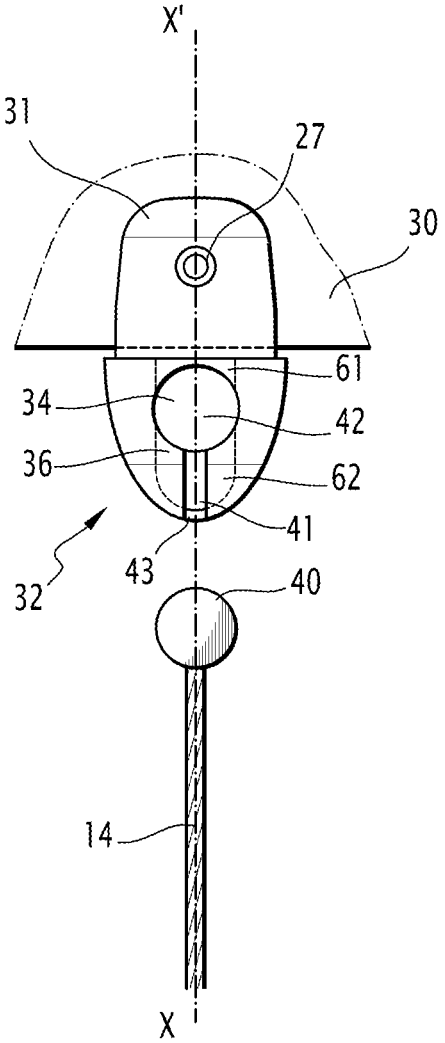
FIG. 3 is a diagrammatic illustration of a locking device of the unit according to the invention.

In reference to FIGS. 1 and 3, the clamps 26 of a panel 12 are positioned on the upstream and downstream edges 30 of the panel 12 at a rate of two clamps 26 per edge 30 and are opposite from one edge 30 to the other, as illustrated by FIG. 1.

Preferably, the clamps 26 of all of the panels 12 are aligned in two parallel directions, which results in minimizing the torsional and flexural strains to which the cables 14 are subjected, and therefore maximizing the lifetime of the unit 10, as well as improving the general appearance of the unit 10.

The clamps 26 comprise two portions 31 designed to be engaged respectively on either side of the panel 12 and have receiving orifices opposite one another for the insertion of an electrically conductive threaded tube 27, secured to the central plate 20, and designed to receive a fastening member for fastening the clamps 26 to the panel 12. The fastening member then simultaneously performs the fastening of one portion 31 to the other and of the clamp 26 to the panel 12.

Each clamp 26 comprises a locking device 32 for locking a cable 14, and more specifically a hammer supported by each of the ends of the cable 14, as will be seen later.

The locking device 32 is made up of a slot 34 and a closed housing 36 that are formed on the clamp 26, the slot 34 emerging in the housing 36 and allowing the insertion of a hammer into the housing 36.

The slot 34 has a shape complementary to the cable 14 and the hammer supported by its end.

The slot 34 thus has a vertical portion 41 with dimensions complementary to those of the cables 14, as well as a substantially circular portion 42.

The vertical portion 341 emerges in the housing 36 and delimits an orifice 43 at the end of the housing 36 by which the cable 14 is made movable in the housing 36, which allows the cable 14 to be moved when the hammer that it carries is moved in the housing 36, as will be seen later.

The portion 42 has a shape substantially complementary to the shape of the hammers supported by each end of the cables 14.

This results in the fact that a cable 14 supporting a hammer at its end is capable of being inserted into the slot 34, such that once the slot 34 is passed, the cable 14 and the hammer are found in the housing 36 and are movable therein along an axis X-X' of the clamp 26.

The housing 36 has a proximal parts 61 (relative to the edge 30) with a cylindrical shape and dimensions larger than or equal to those of the hammers, and a distal part 62 with a shape and dimensions substantially complementary to the shape of the hammers, such that once the hammer is positioned in the housing 36, the hammer is capable of moving therein and cooperating in abutment with the distal parts 62 of the housing 36.

Figure 4:
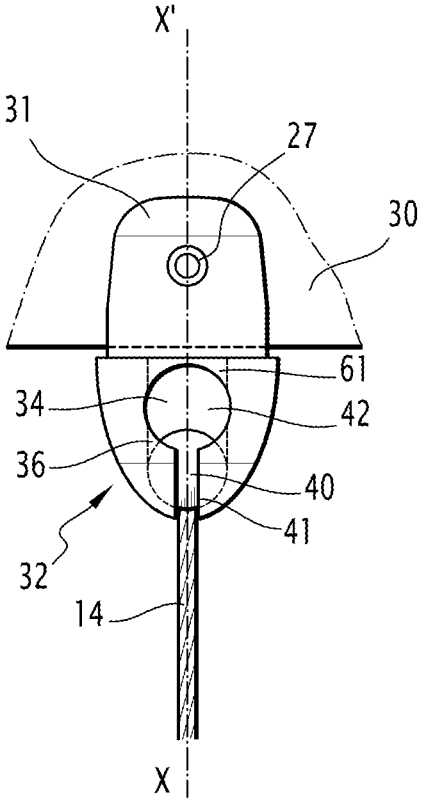
FIG. 4 is another diagrammatic illustration of a locking device of a unit according to the invention.

In the example of FIGS. 3 and 4, the hammers are substantially spherical, the distal part 362 of the housing 36 having the shape of a hemispherical depression.

In reference to FIGS. 3 and 4, either at least under its own weight and that of the cable 14, or under the weight of the panel 12 to which it is connected, the hammer tends to be moved into the housing 36 until it abuts on the distal part of the housing 36 and to be maintained therein.

Preferably, the slots 34 supported by the clamps 26 are all oriented in the same direction, such that each panel 12 has a front face so that when the panel 12 is seen along that face, the slots 34 are not visible.

The transmission device 28 of each panel 12 is capable of allowing the transmission of electrical power through the panel 12 such that a given panel 12 is connected to the source 16 via the upstream panel 12. Furthermore, the device 28 makes it possible to power the light elements 18 of the panel 12.

Each panel 12 is thus powered by the source 16 via the cables 14 and the transmission devices 28 of the panels 12 situated between said panel 12 and the source 16.

To that end, the transmission device 28 comprises two electrically conductive tracks 38 arranged in the extruded slot of the central plate 20 and each connecting a clamp 26 situated on a given edge 30 of the panel 12 to the clamp 26 situated across from it on the opposite edge 30. Furthermore, the transmission device 28 comprises two connecting tracks 39 each connecting one of the clamps 26 of a same edge 30 to the strips 29 in order to power the light elements 18. In practice, the tracks 38 are connected to the threaded tubes 27 situated at the clamps 26 that they respectively connect, and the connecting tracks 39 connect the corresponding tube 27 to the corresponding strip 29.

Alternatively, the tracks 38 are respectively integrated into one of the strips 29 over a portion of their length.

The cables 14 are capable of connecting one panel 12 to another, or one panel 12 to the source 16, both for the transmission of electrical power between the panels 12, or between the source 16 and the panel 12, and to immobilize the panels 12 of the unit 10.

To that end, each cable 14 is made from an electrically conductive material, for example aluminum, stainless steel or copper, and has a sufficient mechanical strength not to break or deform when it bears the weight of several panels 12.

As previously indicated, each cable 14 has two electrically conductive hammers 40 respectively supported by both of the ends of the cable 14.

To fasten a cable 14 to a panel 12, as previously indicated, one of the hammers 40 of the cable 14 is inserted into the slot 34, then into the housing 36 of a clamp 26 of the panel 12, such that the slot 34 and the housing 36 lock the relative movement of the hammer 40 and the cable 14 relative to the clamp 26, and therefore the panel 12.

In order to connect an upstream panel 12 to a downstream panel 12, one of the hammers 40 of the cable 14 is inserted into a clamp 26 of the downstream edge 30 of the upstream panel 12, and the other is inserted into a clamp 26 of the upstream edge 30 of the downstream panel 12.

Inasmuch as each panel 12 has four clamps 26, two cables 14 are thus inserted into the two clamps 26 of the upstream edge 30 of the downstream panel 12 and the downstream edge 30 of the upstream panel 12 to produce both the electrical and mechanical connection between these panels 12, which in particular makes it possible to immobilize the rotation of the two panels relative to one another.

In the example of FIGS. 3 and 4, each hammer 40 has a substantially spherical shape.

Figure 5:
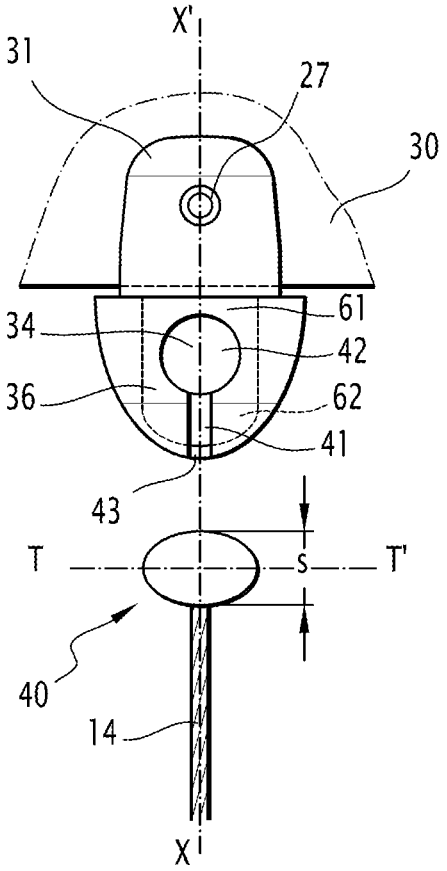
FIG. 5 is a diagrammatic illustration of a locking device according to one alternative of the invention.

Alternatively, in reference to FIG. 5, each hammer 40 has an ovoid shape having a single axis of symmetry of revolution T-T' and each clamp 26 has a slot 34 with dimensions complementary to those of the maximum section S of the hammers 40 along their axis of revolution T-T', such that the insertion or removal of a hammer 40 with respect to a slot 34 requires that the hammer 40 be presented to the slot along its axis of symmetry of revolution T-T'.

As before, the distal part 62 of the housings 36 has a shape complementary to that of the hammers, in the case at hand, a semi-ovoid shape extending along an axis substantially parallel to the plane of the panels 12. Once the hammer 40 is engaged through the slot 34, it must then be pivoted by 90° in order to cooperate with the distal part 62 of the housing 36 that receives it.

This alternative results in preventing any untimely withdrawal of the hammers 40 from the clamps 36, and therefore any unhooking of a panel 12, which could for example occur during manipulation of the unit 10 in order to add or remove a panel 12.

The source 16 provides the panels 12 with very low-voltage electrical power, for example with a voltage of 12 V or 24 V.

The source 16 is positioned upstream from the panels 12, and is for example fastened or integrated to a support to which the unit 10 is designed to be fastened.

The panel 12 closest to the source 16 is then connected to the source 16 via two cables 14 also fastening the unit 10 to its support.

According to the invention, the presence of the transmission devices 28 on the panels 12 results in making one panel 12 be connected to the source 16 via the upstream panel 12, as opposed to a connection to the source 16 via a shared cable to which all of the panels 12 are connected.

More generally, a given panel 12 is connected to the source 16 on the one hand by all of the panels 12 situated between the panel 12 in question and the source 16, and on the other hand via the cables 14 producing the connection of those panels 12 to each other in pairs, such that according to the invention, it is not necessary to have a cable 14 to which all of the panels 12 are connected to power them, and therefore for the operation of the unit 10.

This results in the fact that the connection of the panels to the source 16 no longer prohibits the use of panels 12 with different respective sizes or shapes.

In the example of FIG. 1, the panels 12 each have a generally rectangular shape, the two panels also having different respective widths from one another.

During the operation of the unit 10, the source 16 transfers electrical power to the closest panel 12 via the two cables 24 that connect the source to the panel 12 in question.

The electrical power then passes through the cables 14, the hammers 40, then is communicated to the clamps 26 that are in contact with the hammers 40 and to which the transmission device 28 of the panel 12 is connected.

Via the tracks 38 and 39, the electrical power is then conveyed both to the light elements 18 of the panel 12 to illuminate the document 11 displayed on the panel 12, and to the clamps 26 of the downstream edge 30 of the panel 12.

The electrical power 16 goes from that panel 12 closest to the source 16 via the hammers 40 of the cables connecting said panel 12 to the downstream panel 12, then the cables 14 themselves as far as the clamps 26 of the panel 12, before, as previously, both powering the light elements 18 of the downstream panel 12 in question, and passing through the clamps 26, then the cables 14, then the downstream panel 12 relative to that panel 12.

It should be noted that the tracks 38 of the panels 12 and the successive cables 14 delimit two paths for the electrical power, such that the electrical power is both conveyed from the source 16 to all of the panels 12 and discharged from all of the panels 12 toward the source 16.

Alternatively, it is possible to connect one panel to another via a single cable 14 rather than using two cables 14, the panels 12 only comprising a single clamp 26 on each of their upstream and downstream edge 30.

Figure 19:
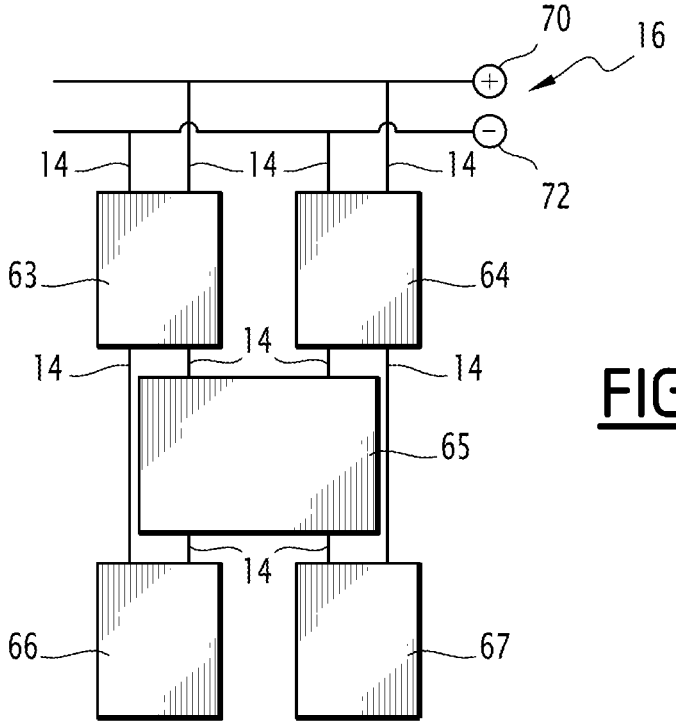
FIG. 19 illustrates an alternative embodiment of the first aspect of the invention.

In the example embodiment illustrated in FIG. 19, the illuminated display unit 10 comprises five display panels 63, 64, 65, 66, 67, distributed over three levels.

Two upper panels 63, 64 are positioned side by side at the upper level. Each is electrically connected by two cables 14 to the electrical power source 16. That source 16 has a positive polarity terminal 70 and a negative polarity terminal 72. One of the two tracks 38 of each upper panel 12 is electrically connected to the terminal 70, and the other is connected to the terminal 72, via one of the cables 14.

An intermediate panel 65 is situated below the two upper panels 63, 64. It is wider than the upper panels 63, 64.

With respect to the electrical power source 16, the upper panels 63, 64 constitute two upstream display panels and the intermediate panel constitutes a downstream display panel within the definition above. More specifically, the intermediate display panel 65 is connected to each of the two upper display panels 63, 64 by a cable 14, the intermediate display panel 65 being electrically connected to the electrical power source 16 via the transmission devices 28 of the two upper display panels 63, 64.

The intermediate display panel 65 is electrically connected to the positive polarity terminal 70 of the electrical power source 16 via the transmission device 28 of the upper display panel 63, and is electrically connected to the negative polarity terminal 72 of the electrical power source via the transmission device 28 of an upper display panel 64.

Two lower display panels 66, 67 are situated below the intermediate panel 65, side by side. These lower panels 66, 67 are each smaller than the intermediate panel 65. With respect to the electrical power source 16, the two upper panels 63, 64 and the intermediate panel 65 constitute upstream panels, and the two lower panels 66, 67 constitute downstream panels within the meaning provided above.

More specifically, each lower display panel 66, 67 is directly connected to one of the two upper panels 63, 64 by a cable 14 and to the intermediate panel 65 by another cable 14. Thus, the lower display panel 67 is electrically connected to the positive polarity terminal 70 of the electrical power source 16 via the transmission device 28 of the upper panel 64 situated above it. It is electrically connected to the negative polarity terminal 72 of the electrical power source 16 via the transmission device 28 of the upper panel 64 and via the transmission device 28 of the intermediate panel. The second lower panel 66 is electrically connected to the negative polarity terminal 72 of the electrical power source 16 via the transmission device 28 of the upper panel 63 situated above it. It is electrically connected to the positive polarity terminal 70 of the electrical power source 16 via the transmission device 28 of the upper panel 63 and via the transmission device 28 of the intermediate panel 65. The panels 66 and 67 are thus connected in parallel to the intermediate panel 65.

A second embodiment of the invention will now be described in reference to FIGS. 6 to 12.

In reference to FIG. 6, the illuminated display unit 110, hereinafter referred to as the unit 110, is suspended vertically from a support 112 provided with or connected to an electrical power source E, and designed to perform the illuminated display of documents 113.

The unit 110 comprises electrically conductive cables 114 as well as display panels 116, hereinafter referred to as panels 116.

The cables 114 suspend the panels 116 from one another or from the support 112, and the transmission of electrical power between the electrical power source E, hereinafter referred to as the source E, and the display panels 116. Two given panels 116 are thus suspended from one another by two cables 114.

The cables 114 are made from aluminum, stainless steel or copper.

Furthermore, with the exception of two cables 114' suspending the first display panel 116 from the support 112, the cables 114 each include two hammers 118 respectively fastened to each of the ends of the cable 114.

A "hammer" refers to an object with a section larger than that of the cable 114 to which it is fastened.

The cables 114' are only provided with one hammer 118, and then connect the first panel 116 to the support 112, for example using a device as described in document FR 2,945,385 A1.

Each hammer 118 has a substantially ovoid shape with a single axis of symmetry of revolution T.

The panels 116 perform the illuminated display of at least one thin document 113 and are all rectangular.

Figure 6:
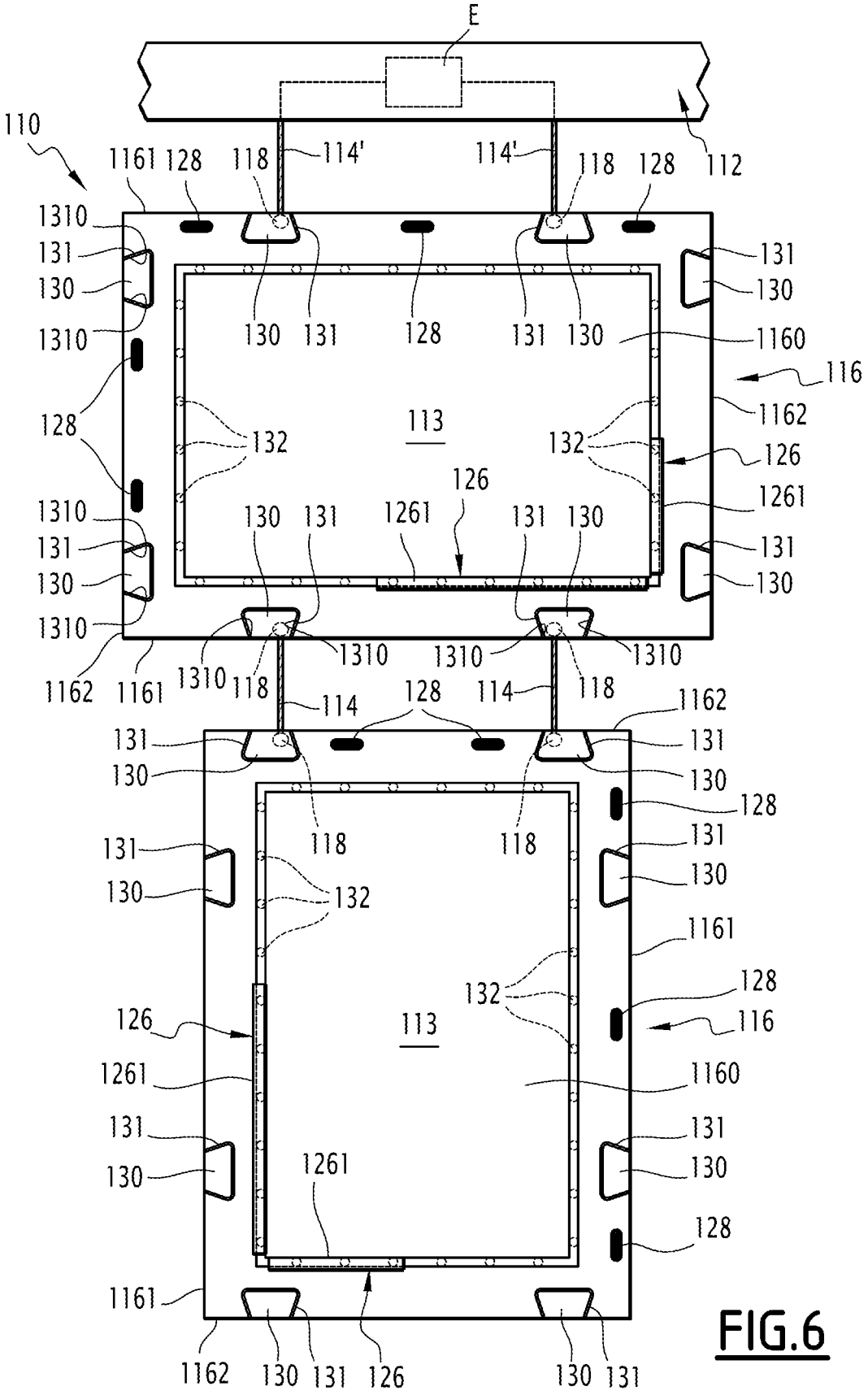
FIG. 6 is a diagrammatic illustration of an illuminated display unit according to a second embodiment of the invention, illustrating the first aspect and the second aspect of the invention.
Figure 7:
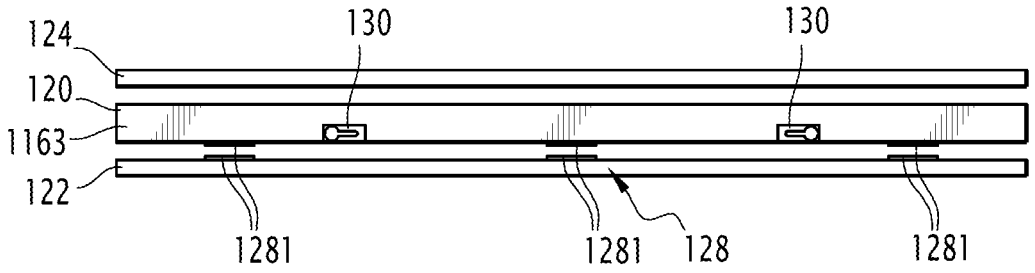
FIG. 7 is a top view of a display panel of the illuminated display unit of FIG. 6.

Each panel 116 has a central part 1160 in which the document(s) 113 are positioned, two longitudinal edges 1161 and two transverse edges 1162 (FIG. 6) as well as a section 1163 (FIG. 7).

In reference to FIGS. 6 and 7, each panel 116 further comprises a central plate 120, as well as a front plate 122 and a rear plate 124. Furthermore, each panel 116 comprises irreversible securing means 126 and reversible securing means 128 for securing the plates 120, 122, 124 to each other.

Lastly, each panel 116 comprises eight clamps 130 incorporated into the display panel 116, an equal number of housings 131 for receiving the clamps 130, and light elements 132.

The plates 120, 122, 124 are made from polymethyl methacrylate, or PMMA, and all have a same rectangular shape. The central plate 120 has a thickness greater than the thickness of the front 122 and rear 124 plates.

In the example of FIGS. 6 and 7, the central plate has a thickness of about 6 mm, the front 122 and rear 124 plates having a thickness of about 1 mm.

The central plate 120 has a surface treatment aiming to send light back from the light elements 132 to the other plates 122, 124.

The front 122 and rear 124 plates comprise an opaque band on their perimeter, such that members other than the central part 1160 of the corresponding panel 116 are concealed when the documents 113 are displayed. As will be understood, these opaque bands have been deliberately omitted from the Figures.

The front plate 122 and the rear plate 124 are respectively fastened to the two opposite large faces of the central plate 120. The plates 120, 122, 124 then give the corresponding panel 116 its general appearance, i.e., the dimensions of the panel 116 substantially correspond to the dimensions of the plates 120, 122, 124 fastened to each other.

The rear plate 124 is irreversibly fastened to the central plate 120, for example by gluing using adhesive strips situated on the perimeter of the panel 116.

Furthermore, two consecutive edges of the front plate 122 are secured irreversibly to the corresponding edges of the central plate 120 via the irreversible securing means 126, the other two edges of the front plate 122 being reversibly secured to the corresponding edges of the central plate 120 via the reversible securing means 128.

In reference to FIG. 6, the irreversible securing means 126 comprise adhesive bands 1261 arranged along the corresponding edges. The adhesive bands 1261 are positioned on the border of the central part 1160.

Preferably, the adhesive bands 1261 associated with a given edge of the corresponding panel 116 extend over a cumulative distance smaller than or equal to 60% of the length of the edge.

As a result, when the front plate 122 is half-open, it does not bear on the central plate 120, which in particular prevents the insertion of a document 113 between those plates.

In reference to FIGS. 6 and 7, the reversible securing means 128 comprise magnets 1281 supported by the front 122 and central 120 plates, and positioned along the two edges of the central plate 120 and the front plate 122 that are not secured irreversibly.

In the example of FIGS. 6 and 7, one of these two edges of the central 120 and front 122 plates bears two magnets 1281, and the other bears three magnets 1281.

The magnets 1281 supported by one of the two plates 120, 122 are then opposite those supported by the other plate 122, 120, and have a complementary polarity.

The simultaneous presence of the reversible securing means 128 and the irreversible securing means 126 facilitates the placement of the documents 113 in the panels 116, as will be seen later.

It should be noted that for better clarity, the magnets have been shown in the Figures as protruding from their respective plates, but in practice, the magnets 1281 are flush with the surface of the corresponding plate.

The clamps 130 of each panel 116 are suitable for receiving the hammers 118, transmitting the electrical power and immobilizing the corresponding panel 116 relative to the cables 114 that suspend them.

The clamps 130 have all of the same dimensions and are respectively forcibly fitted into one of the housings 131. They are then also fastened in their respective housing 131, for example by gluing.

Furthermore, they are made from an electrically conductive material, such as stainless steel, aluminum or copper.

Figure 8:
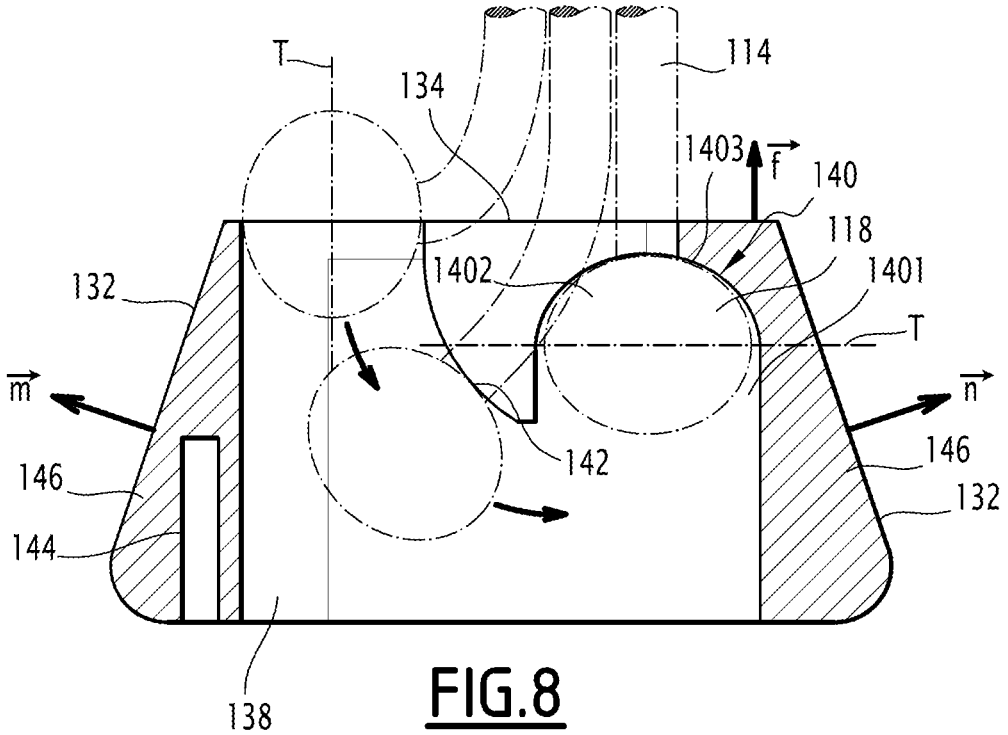
FIG. 8 is a cross-sectional view of a clamp of the panel of FIG. 7.
Figure 9:
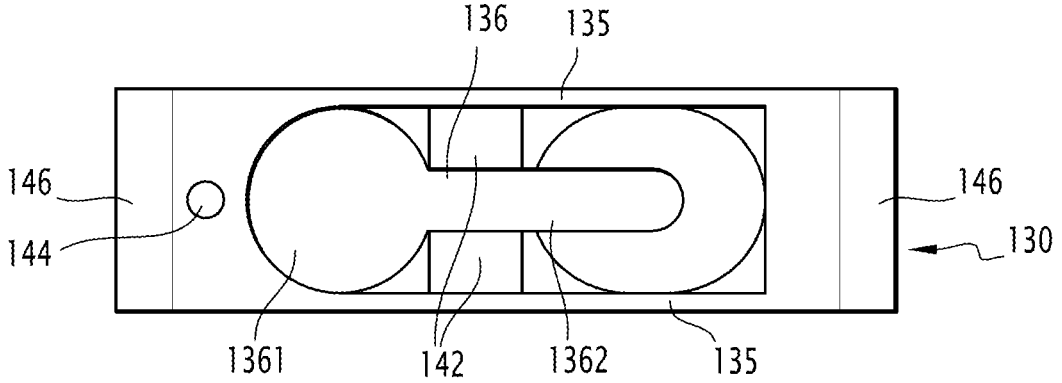
FIG. 9 is a bottom view of the clamp of FIG. 8.

In reference to FIGS. 6, 8 and 9, each clamp 130 has a general prismatic shape with a trapezoidal base and thus has two oblique planar faces 132 respectively oriented by a normal vector $\vec{m}$, $\vec{n}$, respectively, an outer face 134 generated by the small base of the trapezoid and side walls 135. Each clamp 130 also has a blind hole 144 for the insertion of an electrical cable.

Each clamp 130 is hollow and has a central housing 138. The central housing 138 communicates with the outside by a slot 136 formed in the outer face 134.

The central housing 138 is delimited toward the outer face 134 by a bottom delimiting a cavity 140 for receiving and maintaining a hammer 118 in position, and a guide surface 142. Furthermore, the central housing 138 emerges at the large base of the clamp 130.

The oblique faces 132 are inclined relative to the outer face 134 of the corresponding clamp 130. More specifically, the two angles respectively formed by the normal vector $\vec{m}$ and the normal vector $\vec{f}$ at the outer face 134, and by the normal vector $\vec{n}$ and the normal vector $\vec{f}$ are strictly smaller than 90° in absolute value.

This arrangement of the oblique faces 132 of the clamp 130 results in preventing the clamp 130 from leaving its housing 131 when the clamp 130 receives a hammer 118. This is described in more detail below.

The slot 136 has a circular portion 1361 and a rectilinear longitudinal portion 1362 emerging on the circular portion 1361.

The end of the longitudinal portion 1362 that is opposite the circular portion 1361 emerges in the concavity 140.

The circular portion 1361 has dimensions slightly larger than the maximum section of the hammers 118 considered along the axis of symmetry of revolution T.

The longitudinal portion 1362 has a width with a sufficient size to allow only the passage of one cable 114.

The concavity 140 is situated overhanging the end of the longitudinal portion 1362 of the slot 136.

In reference to the orientation of FIG. 8, the concavity 140 comprises a tubular portion 1401 with an ovoid section oriented vertically, and a semi-ovoid portion 1402 also oriented vertically and on which the tubular portion 1401 and the longitudinal portion 1362 of the slot 136 emerge.

When the clamp 130 receives a cable 114, the surface 1403 that delimits the semi-ovoid portion 1402 then cooperates abutting with the hammer 118 situated at the end of that cable 114. This is described in more detail below.

The guide surface 142 is suitable for performing the guiding of a hammer 118 inserted into the circular portion 1361 between the slot 136 and the concavity 140.

The guide surface 142 has a generally convex shape toward the central housing 138. One of its ends is located at the circular portion 1361 of the slot 136, and its other end emerges on the tubular portion 1401 of the concavity 140.

In reference to FIGS. 8 and 9, the longitudinal portion 1362 of the slot 136 emerges on the central housing 138 at the guide surface 142, and over the entire length of the guide surface 142. Thus, the movement of a hammer 118 along the guide surface 142 occurs naturally when the corresponding cable 114 is moved in the longitudinal portion 1362.

The blind hole 144 is designed to receive an electrical cable and is formed in one of the material zones 146 adjacent to the central housing 138.

There are eight housings 131 of a given panel 116, and they are formed in one of the faces of the central plate 120 at the edges 1161, 1162 at a rate of two per edge.

In the example of FIG. 6, the housings 131 are all formed in part of the thickness of the central plate 120 at the large face of the central plate 120 oriented toward the front plate 122.

The housings 131 of a given edge 1161, 1162 are across from those of the opposite edge 1161, 1162.

For a given panel 116, the spaces between two clamps 130 of a same edge 1161, 1162 are all the same.

Preferably, the spacing between a given housing 131 (and therefore clamp 130) and the other of the same edge 1161, 1162 is substantially the same for all of the housings 131 of all of the panels 116 of the unit 110.

Each housing 131 has a shape complementary to that of the clamps 130. In the example of FIGS. 6 to 9, each housing 131 therefore has a generally trapezoidal shape. In particular, the housing 131 is delimited laterally, i.e., in a direction parallel to the corresponding edge 1161, 1162, by two inclined surfaces 1310 respectively designed to cooperate with one of the oblique faces 132 of the clamp 130 that it receives.

These inclined surfaces 1310 diverge from the section 1163 toward the central part 1160 of the panel 116. The normal vectors $\vec{m}$, $\vec{n}$ of the oblique faces 132 of the clamps 130 are then oriented in the direction opposite the central part 1160 of the corresponding panel 116, and the panel 116 in general.

In reference to FIGS. 6 and 8, the small base of each housing 131 is open and is aligned with the section 1163.

As a result, once the clamp 130 is received in its housing 131, the clamp 130 is housed and incorporated in the corresponding panel 116 and does not protrude relative to the panel 116. Its outer face 134 is aligned with the section 1163 of the panel 116 and oriented toward the outside of the panel 116 and is accessible from the outside of the panel 116, such that the slot 136 is also oriented toward the outside of the panel 116 and is accessible from the outside of the panel 116. Furthermore, one of the side walls 135 of the clamp 130 is aligned with the face of the central plate 120 in which the housing 131 is formed.

Thus, the clamps 130 of a given panel 116 do not protrude from the panel 116, which improves the aesthetics of the unit 110. This is particularly true when the front 122 and rear 124 plates have an opaque perimeter. This is described in more detail below.

The light elements 132 of each panel 116 are positioned on rectilinear strips formed around the central part 1160 and oriented toward the latter.

The light elements 132 are for example light-emitting diodes, or LEDs.

The strips are electrically connected to each other. They are also electrically connected to the clamps 130 via electrical cables (not shown) respectively inserted and welded in the blind hole 144 of the corresponding clamp 130.

In reference to the Figures, the construction of a panel 116 from plates 120, 122, 124 will now be described.

First, the housings 131 are formed in the edges of the central plate 120. Then, the clamps 130 are in turn fastened in the housings 131. To that end, for a given clamp 130, the clamp 130 is brought closer to the housing 131. Then, the electrical cable designed to connect the clamp 130 to a strip is inserted and fastened in the blind hole 144.

The clamp 130 is then forcibly fitted in the corresponding housing 131, for example after having coated one or more of the surfaces of the clamp 130 with adhesive glue.

The reversible 128 and irreversible 126 securing means are positioned around the face of the central plate 120 and the front plate 122.

Lastly, the rear plate 124 is secured to the central plate 120, and the central plate 120 is secured to the front plate 122 at the corresponding edges 1161, 1162 irreversibly, reversibly, respectively.

The operation of the unit 110 will now be described in reference to the Figures.

In reference to FIG. 6, the clamps 130 positioned on the edges 1161, 1162 positioned horizontally of the panels 116 (i.e., the transverse edges 1162 if the corresponding panel 116 is in portrait mode, and the longitudinal edges 1161 if the panel 116 is in landscape mode) each receive the hammer 118 of one of the two cables 114 by which the corresponding panel 116 is suspended. The weight of a given panel 116 is then reacted by the upper panel 116 or the support 112.

The clamps 130 positioned on the edges 1161, 1162 positioned vertically do not receive a hammer 118.

Under the effect of the weight of the panel 116, the surface of the hammers 118 cooperates and is kept abutting against the surface 1403 delimiting the semi-ovoid portion 1402 of the concavity 140 of the corresponding clamp 130, which immobilizes the corresponding cable 114 relative to the clamp 130.

The clamps 130 are immobilized in their respective housings 131 by cooperation of their oblique faces 132 with the corresponding inclined surfaces 1310 due to the orientation of the oblique faces 131 and the inclined surfaces 1310.

The electrical power is transmitted from the source E to the panels 116 and from the panels 116 to the source E via the electrically conductive cables 114, the clamps 130 and the strips on which the light elements 132 are positioned.

More specifically, for a given panel 116, the electrical power is conveyed by one of the cables 114 suspending the panel 116, and is transmitted to the corresponding clamp 130 at the surface 1403. It is then communicated to the light elements 132 via the strips and the electrical cables, which also convey the electrical power to the clamp 130 situated opposite on the other edge 1161, 1162.

Likewise, the other two clamps 130 receive hammers 118 and the strips define a second path for the return of the electrical power from the panel 116 to the upper panels 116.

In order to insert a hammer 118 into a clamp 130, the hammer 118 is brought close to the section 1163 at the clamp 130, and is presented to the circular portion 1361 of the slot 136 of the clamp 130 along its axis of symmetry of revolution T. Then it is inserted through the slot 136. The cable 114 supporting the hammer 118 is then moved in the longitudinal portion 1362 of the slot 136, which results in guiding the hammer 118 along the guide surface 142 as far as the concavity 140. This movement of the hammer 118 along the convex guide surface causes the axis of symmetry of revolution T of the hammer 118 to pivot, which is then presented to the tubular portion 1401 of the concavity 140 in a position in which its axis of symmetry T is substantially horizontal (relative to the orientation of FIG. 8).

The cable 114 is next moved upward along its axis until the hammer 118 abuts against the surface 1403.

Conversely, to remove the hammer 118 from a clamp 130, the cable 114 must be moved vertically relative to the panel 116 until the hammer 118 leaves the concavity 140. The cable 114 is then translated horizontally so that the hammer 118 abuts against the guide surface 142 when it leaves the concavity 140. Then, the cable 114 is simultaneously pulled upward and translated sideways in the longitudinal portion 1362, such that the hammer 118 is moved along the guide surface 142.

Due to the shape of the guide surface 142, the hammer 118 is then pivoted during its movement, and is thus presented to the circular portion 1361 along its axis of symmetry of revolution T.

The guide surface 142, and the both precise and simple movement that it imposes to cause the hammer to leave the central housing 138, results in preventing the hammers 118 from leaving the clamps 130 in an untimely manner, which improves safety during the placement or handling of the panels 116.

In fact, in the event of an untimely withdrawal of the hammer 118 from the concavity 140, for example in case of impact, it is relatively unlikely that the hammer 118 will engage on the guide surface 142 once it leaves the concavity 140. It will then not be pivoted and will not be presented to the slot 136 along its axis of symmetry of revolution T, such that it will not be able to leave the clamp 130 due to its ovoid shape.

In order to insert a document 113 in the panel 116, the user separates the front plate 122 from the central plate 120 at the edges 1161, 1162 on which the reversible securing means 128 are situated.

In the example of FIGS. 6 and 7, it then suffices to separate the front plate 122 from the central plate 120, for example by relative pulling with respect to one another, which results in making the central part 1160 accessible.

The document can then easily be inserted between the front 122 and central 120 plates until it abuts against the adhesive bands 1261.

As will then be understood, preferably, the panels 116 of the unit 110 are positioned such that the upper edge 1161, 1162 of the panel 116 corresponds to one of the two edges 1161, 1162 at which reversible securing means 128 are located. As a result, the documents 113 inserted into the central part 1160 do not fall from the panel 116 when the front 122 and central 120 plates are partially open relative to one another.

The incorporation of the clamps 130 and the panels 116 results in improving the aesthetics of the panels 116, particularly when the front 122 and rear 124 plates have an opaque perimeter.

Also as a result of this, providing the panels 116 with eight clamps 130 at a rate of two per edge 1161, 1162 is not detrimental to the aesthetics of the panels.

As a result of this feature, each panel 116 has two display modes—a landscape mode and portrait mode—as opposed to the panels of the state of the art, which only have one display mode defined during construction.

For a given panel 116, the display mode of the adjacent panels 116 is then irrelevant, particularly when the clamps 130 are all spaced apart from the other clamp 130 of the same edge 1161, 1162 by the same distance. In fact, as a result of the latter feature, the cables 114 are not subject to any flexural or torsional stress after passage of the immediately higher or immediately lower panels from one display mode to another.

Furthermore, the fastening of the panels 112 is secure due to the configuration of the clamps 130, housings 131 and hammers 118.

More specifically, the ovoid shape of the hammers 118 and the guide surface 142 prevents the hammers 118 from leaving the clamps 130 in an untimely manner.

Furthermore, the trapezoidal shape of the clamps 130 and the orientation of their oblique surfaces 132 in the housings 131 prevent the clamps 130 from leaving their housing 131 and prevents unfastening of the panels 116.

Lastly, the arrangement of the reversible 128 and irreversible 126 securing means along two successive edges facilitates the placement of documents 113.

This is particularly true in comparison with display units of the state of the art in which the panels are irreversibly secured at least partially on three consecutive edges. In fact, in that scenario, the separation of the front 122 and central 120 plates from each other is less significant, which makes it difficult to insert documents 113.

Figure 10:
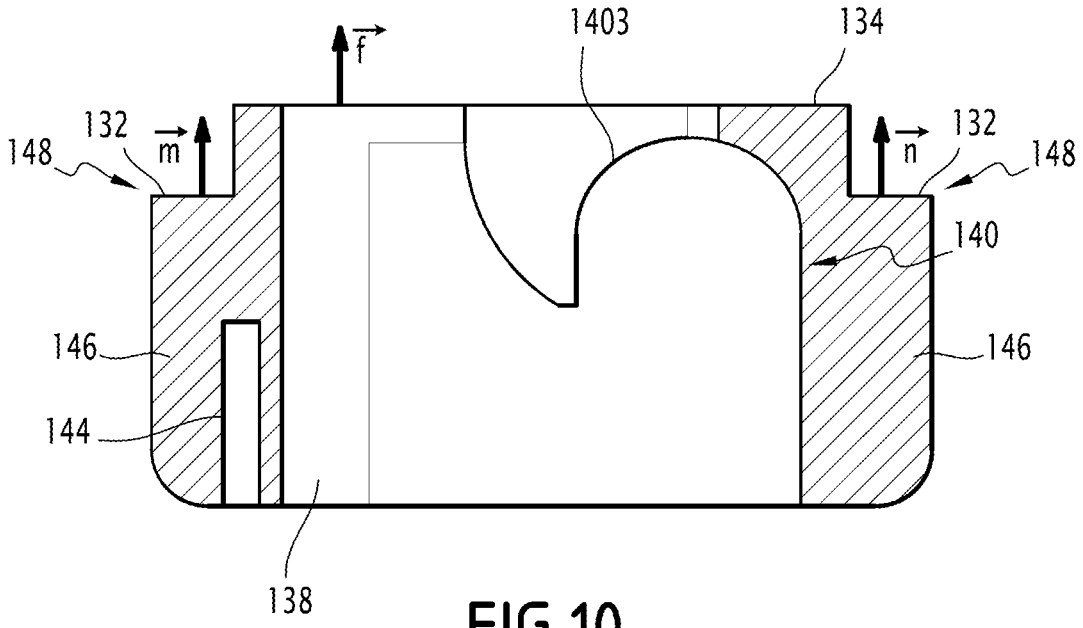
FIG. 10 is a view similar to the view of FIG. 8 of a clamp of a panel according to one alternative of the invention.

Alternatively, in reference to FIG. 10, one or more of the clamps 130 has a generally parallelepiped shape having two shoulders 148 formed on either side of the outer face 134.

In the example of FIG. 10, the shoulders 148 are formed at the longitudinal ends of the outer face 134.

The oblique faces 132 are delimited by the shoulders 148 and are inclined relative to the outer face 134.

More specifically, in the context of this alternative, the oblique faces 132 are parallel to the outer face 134, the angles formed between the vectors normal to those faces being zero. The inclined surfaces 1310 of the housings 131 suitable for receiving the clamps 130 having this shape are oriented toward the central part 1160 of the corresponding panel 116.

As previously described, this arrangement of the oblique faces 132 and their cooperation with the inclined surfaces of the corresponding housing 131 results in increasing the safety of the suspension of the panels 116 from the unit 110 while preventing the clamps 130 from leaving their housing 131.

Alternatively (not shown), the clamps 130 have a depth substantially equal to the thickness of the central plate 120. In this alternative, the corresponding housings 131 then emerge through the central plate 120.

Figure 11:
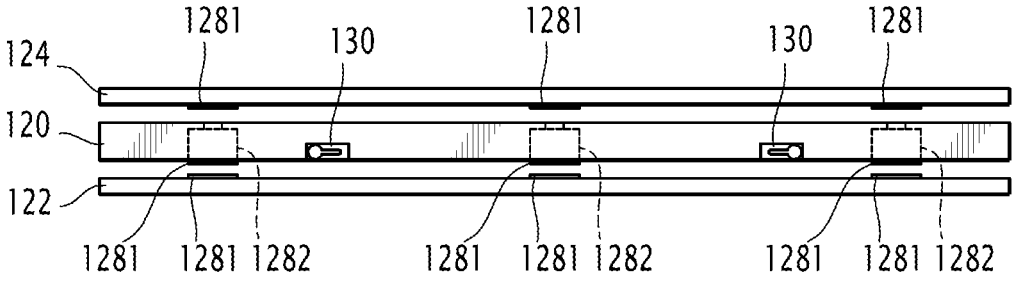
FIG. 11 is a view similar to the view of FIG. 7 of a display panel of a display unit according to one alternative of the invention.

Alternatively, in reference to FIG. 11, the rear plate 124 is fastened to the central plate in the same way as the front plate 122.

More specifically, the irreversible securing means 126 comprise adhesive bands 1261 fastened on the rear face of the central plate 120 along two consecutive edges. These edges are for example the same two edges as those at which the front plate 122 is irreversibly secured to the central plate 120.

Furthermore, the reversible securing means 1281 comprise magnets 1281 supported by the rear plate 124 at two consecutive edges. These two edges are for example those at which the front plate 122 is reversibly secured to the central plate 120.

The magnets 1281 supported by the rear plate 124 are across from those supported by the central plate 120.

The magnets 1281 supported by the central plate 120 have a depth slightly smaller than the thickness of the central plate 120 and are engaged in respective blind receiving orifices 1282 at the bottom of each of which an aperture 1283 is formed emerging on the rear plate 124.

The presence of the apertures 1283 results in limiting the attenuation of the attraction of the magnets 1281 supported by the central 120 and rear 124 plates due to the thickness of material between the bottom of the receiving orifices 1282 and the rear plate 124.

It should be noted that the magnets 1281 have been shown in FIG. 11 as protruding from their respective plates, but that in practice, the magnets 1281 are flush with the surface of the corresponding plate.

This alternative is advantageously implemented in order to have panels with two faces using which document presentation can be done.

Preferably, the colors of the front 122 and rear 124 plates are then different.

Figure 12:
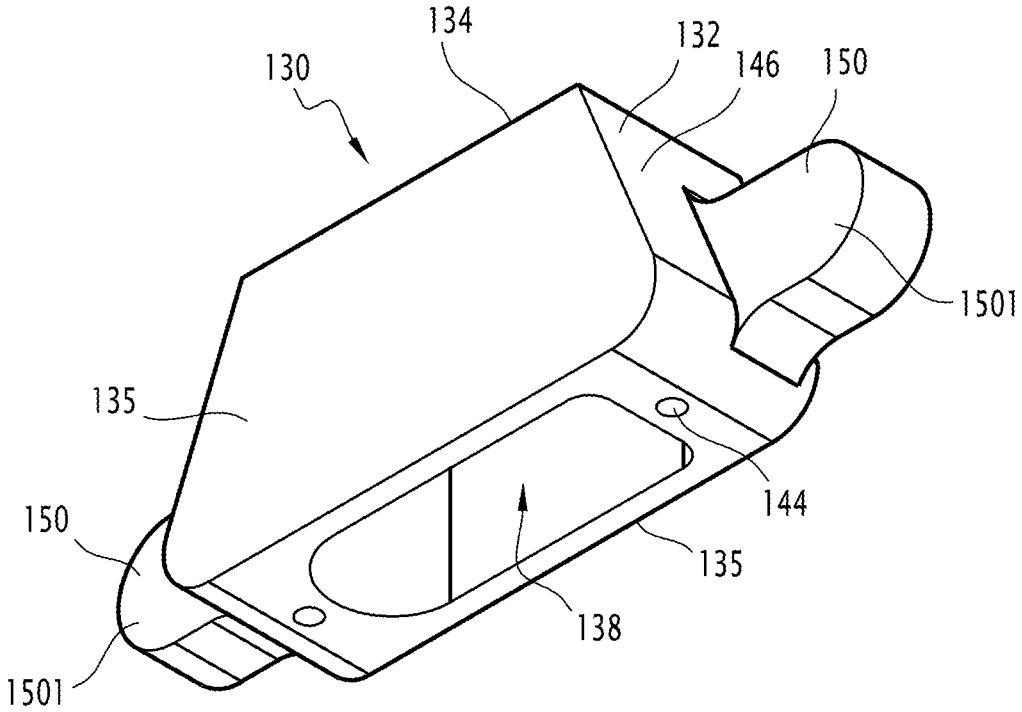
FIG. 12 is a bottom perspective view of a clamp of a panel of a device according to one alternative of the invention.

Alternatively, in reference to FIG. 12, at least one of the clamps 130 comprises two lugs 150 respectively secured to one of the oblique faces 132 and extending laterally from the corresponding oblique face 132.

In the example of FIG. 12, the lugs 150 are respectively integral with one of the material zones 146.

Each lug 150 has a depth smaller than the depth of the clamp 130, for example a depth equal to approximately half of the depth of the clamp 130.

Furthermore, each lug 150 has a tongue shape cooperating with a planar surface 1501 substantially parallel to the side walls 135 and opposite the side face 135 designed to be flush with the front plate 120.

In a complementary manner, the housings 131 each comprise two depressions extending laterally from inclined surfaces 1310 and with a shape complementary to the lugs 150. The depressions are situated at a distance from the face of the corresponding central plate 120 substantially equal to the distance between the side wall 135 of the clamp 130 designed to be flush with the surface of the central plate 120 and the planar surface 1501.

The depressions of a given housing 131 each receive a lug 150 once the clamp 130 is inserted in the housing 131.

The presence of the lugs 150 and their cooperation with the depressions in the housings 131 results in facilitating the placement and adjustment of the position of the clamps 130 in the housings 131, as well as guaranteeing the flush arrangement of the clamps 130 relative to the central plate 120.

In fact, in the construction of the panels 116 according to this alternative of the invention, each clamp 130 is fitted into a housing 131 until the lugs 150 of the clamp 130 abut against the depressions of the housing 130.

The lugs 150 and the depressions then oppose the pivoting of the clamp 130 around its central axis when it is inserted into the housing 131, which for example occurs when the force applied to the clamp 130 is not perfectly centered on the central axis of the clamp.

Furthermore, the abutment of the lugs 150 with the depressions means that the side wall 135 of the clamp 130 is situated at the surface of the central plate 120 with which it is designed to be flush.

The flushness of the side wall 135 with the surface of the central plate 120 is then adjustable in particular by pressing on the lugs 150 of the clamp 150.

In another embodiment of this alternative, the lugs 150 are secured to any face of the clamp 130, with the exception of the side walls 135. This would in fact prevent proper flushness of the clamp 130 with the central plate 1120. The lugs 150 then extend from the clamp 130 in a direction opposite the clamp. The shape of the housings 131 is adapted accordingly.

In other embodiments, the clamp 130 comprises one or more than two lugs 150. The shape of the housings 131 is then adapted accordingly.

In one alternative embodiment, each panel 116 includes clamps 130 that are not electrically conductive along the two longitudinal edges 1161, and includes clamps 130 that are electrically conductive along two transverse edges 1162. The nonconductive clamps can be used to fasten panels to supports such as cables or bars. The conductive clamps are used to bring electrical current to the light elements 132.

Conversely, the nonconductive clamps can be positioned along transverse edges and the conductive clamps along longitudinal edges.

Preferably, the nonconductive clamps and the conductive clamps are provided to be removed from their housings 131, so as to be able to modify their positions on each panel and thus modify the orientation of the panel as desired.

The third aspect of the invention will now be described, in reference to FIGS. 13 to 18.

Below, the terms "lower", "upper" and "vertical" are used in reference to the Figures and non-limitingly.

In reference to FIG. 13, the illuminated display unit 210 according to the invention, hereinafter referred to as the unit 210, is designed to perform the illuminated display of documents 211. It is designed to be suspended vertically.

The unit 210 comprises at least one electrically conductive cable 212, at least one display panel 214, hereinafter referred to as the panel 214, and an electrical power source 216 designed to supply the panels 214 with electrical power. Furthermore, it comprises a support 217 for suspending the unit 210.

Each cable 212 comprises two hammers 218 respectively fastened to each of its ends and capable of cooperating with a housing comprised by clamps fastened to the panels 214.

Figure 13:
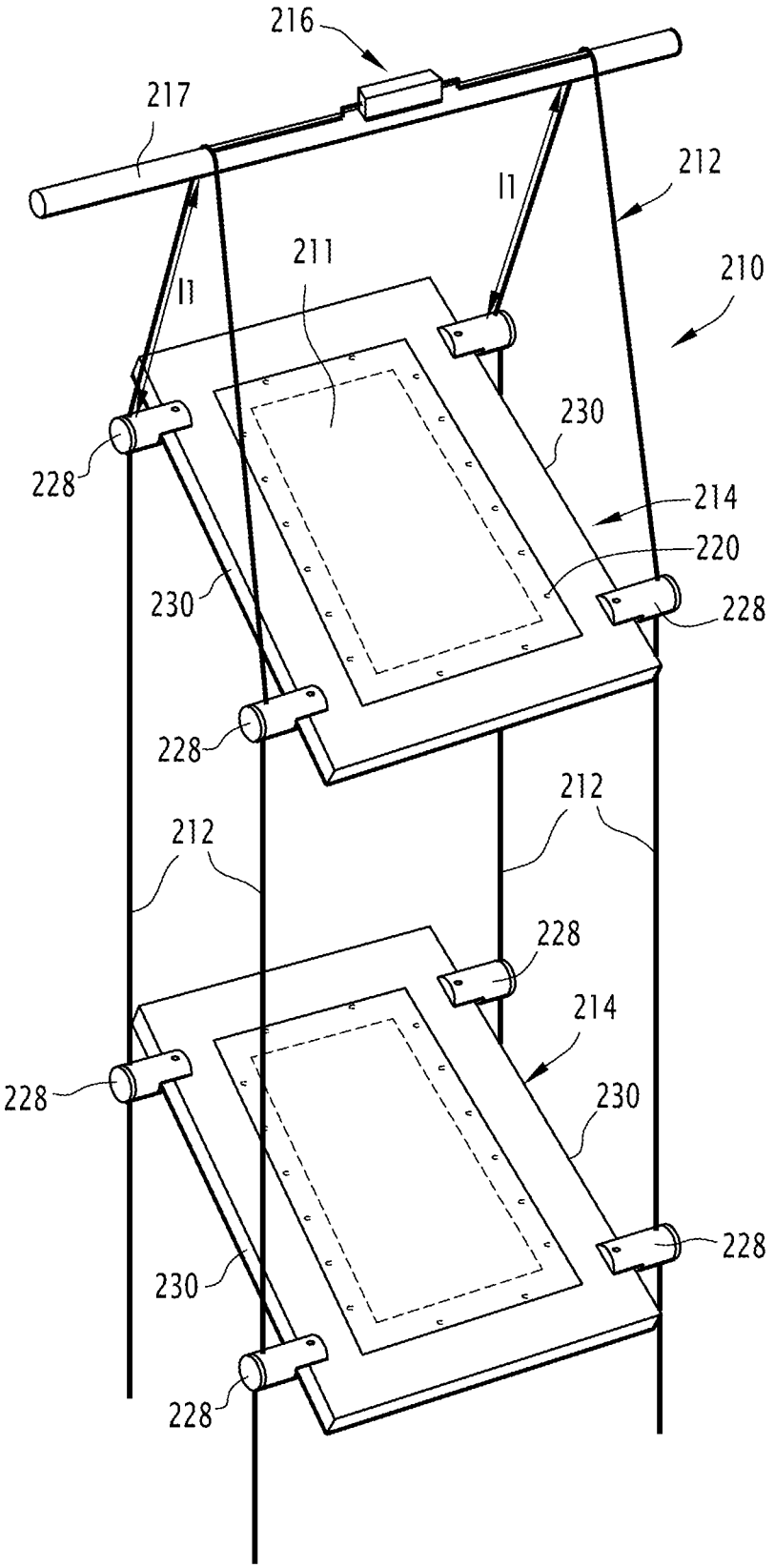
FIG. 13 is a diagrammatic illustration of an illuminated display unit illustrating the third aspect of the invention.

In the example of FIG. 13, the unit 210 is arranged vertically and the panels 214 are superimposed. A given panel 214 is then suspended from the immediately higher panel 214 via four cables 212, the weight of a given panel 214 being entirely reacted by the immediately higher panel 214.

Figure 14:
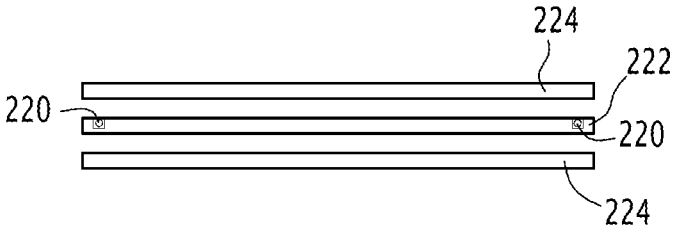
FIG. 14 is a top view of a panel of the illuminated display unit of FIG. 13.

In reference to FIGS. 13 and 14, each panel 214 comprises a plurality of light elements 220, a central plate 222 in which the light elements 220 are arranged, as well as two secondary plates 224 designed to be fastened to the central plate 222 parallel to and on either side of it.

Furthermore, each panel 214 includes four electrically conductive clamps 228 each capable of cooperating with at least one cable 212.

The light elements 220 are capable of lighting the document(s) 211 that the panel is designed to illuminate. To that end, the light elements 220 are positioned on strips (not shown) oriented toward the center of the panel 214 and selectively connected to each other. These strips are positioned in an extruded slot formed in the perimeter of the central plate 222.

In the example of FIGS. 13 and 14, the light elements 220 are light-emitting diodes.

The central plate 222 and the secondary plates 224 are translucent and made from polymethyl methacrylate, also known as PMMA.

The central 222 and secondary 224 plates have substantially equal dimensions. In the example of FIGS. 13 and 14, they all have a generally rectangular shape.

As previously indicated, the central plate 222 has an extruded slot formed on its perimeter for receiving the light elements 220. Furthermore, the central plate 222 has a surface treatment capable of returning the light emitted by the light elements 220 toward the secondary plates 224, which improves the illumination of the document(s) 211.

In order for the panel 214 to display a document 211, said document is inserted between one of the secondary plates 224 and the central plate 222, such that the fastening of the plates to one another causes immobilization of the document 211 in the panel 214.

The central 222 and secondary 224 plates are simultaneously fastened to one another, for example by screwing. One or both of the secondary plates 224 have a layer of opaque paint on its/their perimeter aiming to conceal an electrical device comprised by the panel 214 as well as the strips formed in the panel 214.

Each panel 214 has at least two edges 230 opposite one another, on each of which two of the four clamps 228 comprised by the panel 214 are arranged.

In the example of FIG. 13, each panel 214 has a general rectangular shape and comprises four edges 230 opposite in pairs.

Furthermore, each panel 214 comprises an electrical device (not shown) for conveying electrical power passing through the cables 212 through which the panel 214 is connected to an upstream panel 214 or to the source 216 intended for the light elements 220.

To that end, the electrical device comprises two electrical connectors (not shown) each connecting one of the clamps 228 of a same edge 230 to the strips. In practice, each connector is connected on the one hand to the strip in question, and on the other hand to an electrically conductive threaded tube in contact with the clamp 228 in question and through which the clamp 228 is fastened to the panel 214.

The clamps 228 are each fastened to the panel 214 and cooperate with two cables 212, one of which is used to suspend the panel 212 from the upstream panel 212 and the other of which is used to suspend the downstream panel 212 from the panel 212. Furthermore, they are capable of transferring electrical power between the cables 212 that are engaged therein and the electrical device.

To that end, each clamp 228 is made from conductive material, for example aluminum, stainless steel or copper.

Figure 15:
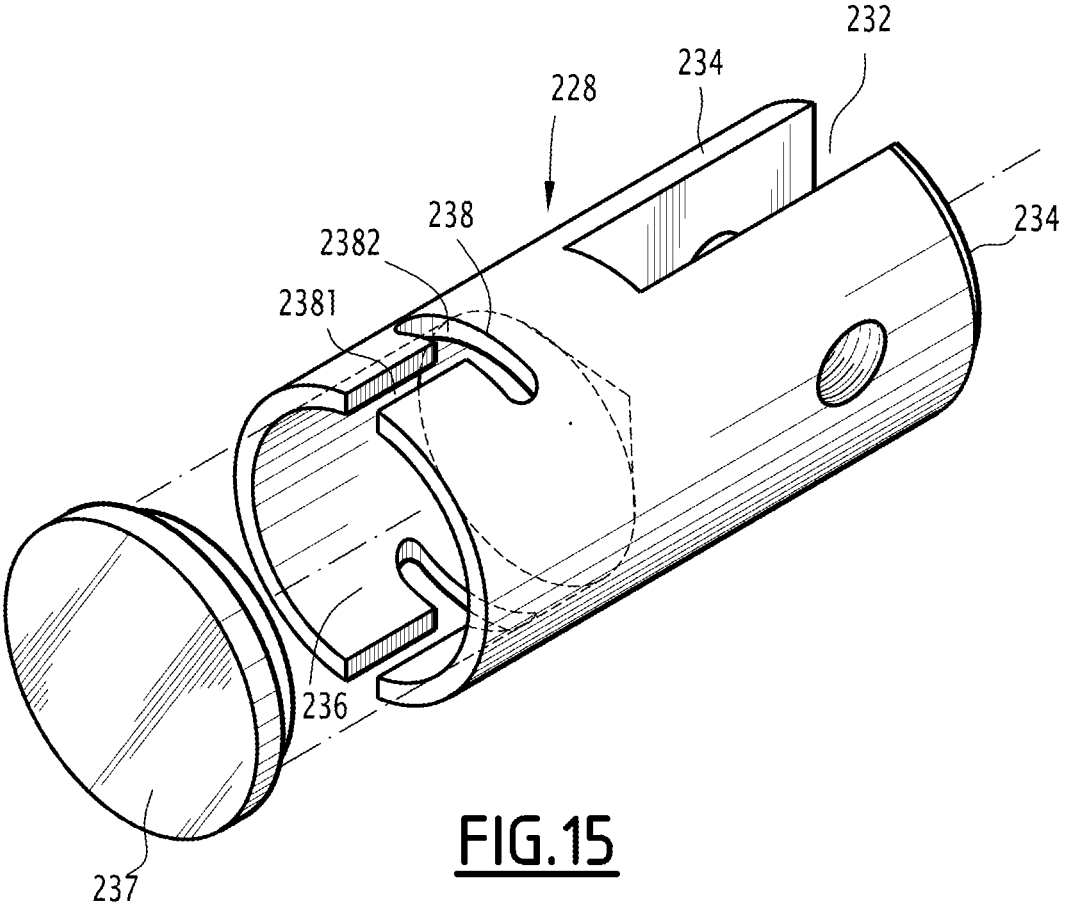
FIG. 15 is a diagrammatic illustration of the clamp of a panel of the illuminated display unit of FIG. 13.

In reference to FIG. 15, each clamp 228 has a generally cylindrical shape and comprises a longitudinal through slot 232 that delimits two portions 234 of the clamp 228.

In reference to FIG. 15, each clamp 228 has a height along its axis comprised between 25 and 30 mm, and advantageously equal to 28 mm, and a diameter comprised between 12 and 17 mm, advantageously equal to 14 mm.

The slot 32 is designed to be engaged on one of the opposite edges 230 of the panel 214 such that the portions 234 engage on either side of the edge 230.

An orifice for receiving a fastening member is formed in each of the portions 234, the two orifices facing each other, only one of the fastening orifices being a through orifice. As previously indicated, a threaded tube (not shown) that is electrically conductive and secured to the central plate 222 is engaged in the fastening orifices.

In order to fasten a clamp 228 to an edge 230, the fastening member is inserted, then screwed in the threaded tube engaged in the fastening orifices across from one another, such that the portions 234 are pressed on the edge 230 of the panel 214.

Each clamp 228 also has a housing 236 emerging at the end of the clamp 228 and with a cylindrical shape, as well as a cap 237 for closing off the housing 236.

The housing 236 is capable of receiving two hammers 218 for fastening the clamp 228 relative to the cables 212 at the ends of which the hammers 218 are fastened, and has a threading (not shown) near the end of the clamp 228.

Each clamp 228 comprises two bowed slots 238 formed in the wall of the housing 236 that are each capable of receiving a cable 212 provided with a hammer 218 and allowing the sliding of the cable 212 in the corresponding bowed slot 238 for the travel of the cable 212 and the modification of the angular position of the clamp 228 relative to the corresponding cable 212.

The two bowed slots 238 of each clamp 228 are arranged across from one another in the wall of the housing 236, i.e., are diametrically opposite, and have the same orientation as the slot 232, such that once the clamp is fastened to a panel 214, the bowed slots 238 are oriented along the plane of the panel 214.

Each bowed slot 238 comprises a longitudinal portion 2381 emerging on the end of the housing 236 and the clamp 228, as well as a bowed portion 2382 emerging at its center on the longitudinal portion 2381. The two portions 2381, 2382 have dimensions complementary to those of the cables 212.

The bowed portion 2382 further has an angular width comprised between 30° and 60°, for example equal to 45°.

In order to fasten a cable 212 to a clamp 228, one of the hammers 218 of the cable 212 is presented at the end of the housing 236, the cable 212 being presented at the longitudinal portion 2381 of one of the bowed slots 238.

The hammer 218 is then inserted into the housing 236, then moved in the longitudinal direction of the clamp 228 until the cable 212 emerges on the bowed portion 2382 of the slot 238. The cable 212 is incapable of sliding in the bowed portion 2382 for the relative rotation of the panel 214 with respect to the cable 212, the hammer 218 being pressed against the inner surface of the housing 236.

In fact, under the effect of its weight, the weight of the cable 212 and/or of the panel 214 to which the cable 212 to which it belongs is fastened by its other end, once released, the hammer 218 is pressed against the inner surface of the housing 236, thereby fixing the position of the clamp 228 along the corresponding cable 212.

The four clamps 228 of a panel 214 are positioned on the panel 214 at a rate of two clamps 228 per opposite edge 230.

Preferably, when the panels 214 are rectangular, the clamps are positioned on the opposite lateral edges 230, such that the cables do not pass in front of the panels 214, which would make them difficult to read. The clamps situated on a same edge 230 are then positioned across the clamps 228 situated on the other edge 230, such the two clamps 228 have a same height (relative to the vertical) greater than the height of the other two clamps 228.

Below, among the two clamps 228 situated on a given edge 230 of the panel 214, the clamp 228 that has the maximum height will be described as the upper clamp, the other clamp 228 being described as lower, the upper/lower clamps respectively designating the two clamps 228 with higher/lower heights among the four clamps 228 of the panel 214.

The housing 236 and the bowed slot 238 of each of the clamps 228, as well as a hammer 218 and a cable 212 bearing the hammer 218 and respectively inserted into the housing 236 and the slot 238, define a link 240 of the panel 214 to the cable 212.

According to the invention, each link 240 thus produces the link of a clamp 228 to a cable 212 and allows the relative rotation of the cable 212 with respect to the clamp 228.

Figure 16:
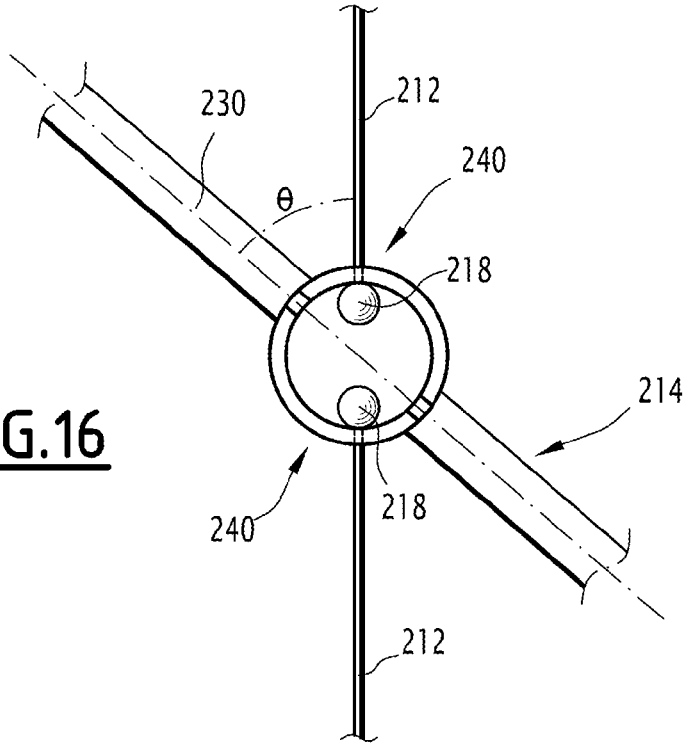
FIG. 16 is a side view of a clamp of a panel of the illuminated display unit of FIG. 13.

The incline between the plane of the panel 214 and the cable 212 in question is identified by an angle θ shown in FIG. 16, the cable 212 being vertically stretched under the effect of the weight of the downstream panel(s) 214.

Each panel 214 is thus suspended from the upstream panel 214 via pivot links 240, such that the rotation of the panel 214 relative to the four cables 240 suspending it from the upstream panel 214 is authorized (or relative to the two cables 212 that suspend it from the support 217, as will be seen), and therefore its rotation relative to the vertical is also allowed.

Preferably, all of the links 240 comprised by the panels 214 are pivot links, such that each panel is capable of pivoting relative to the four cables 212 that suspend it from the upstream panel 212, and therefore of pivoting relative to the vertical of the unit 210.

In reference to FIGS. 13 and 16, each panel 214 having a downstream panel 214 comprises eight pivot links 240, each clamp 228 of each panel 214 being comprised in two links 240 respectively providing the link of the clamp 228 in question to a cable 212 for the suspension of said panel 214 from the upstream panel 214 or from the support 217 and the link of the clamp 228 in question to a cable 212 for the suspension of a downstream panel 214 from said panel 214.

The cap 237 of each clamp 228 is capable of being engaged in the emerging end of the housing 236 to close it off.

To that end, the cap 237 comprises a first cylinder portion with a diameter substantially equal to that of the clamp 228 and a second threaded portion with a diameter substantially equal to that of the housing, with the same axis as the first portion and secured to the first portion. In order to close off the housing 236 or its opening, the second portion is screwed, respectively unscrewed from the end of the housing 236.

The support 217 is designed to suspend the first panel 214. To that end, the support 217 is arranged above the first panel 214 and comprises a beam.

The first panel 214 is suspended using two cables 212 of the same length and passed around the support 217. The cables 212 are not immobilized relative to the support, which makes it possible to modify the vertical incline of the panels 214, as will be seen later.

Each of the cables 212 cooperates with the upper and lower clamps 228 of a same opposite edge 230 of the first panel 214.

The source 216 is capable of supplying the panels 214 with electrical power for the operation of the light elements 220 and therefore the unit 210.

To that end, the source 216 is connected to the cables 212 that suspend the first panel 214 from the support 217, and delivers a very low-voltage electrical power.

In reference to FIGS. 13 to 16, the operation of the unit 210 according to the invention will now be described.

During the operation of the unit 210, the source 216 transfers electrical power to the first panel 214 via the cables 212 that suspend the latter from the support 217.

The hammers 218 and clamps 228 being electrically conductive, the electrical power is both conveyed to the electrical device of the first panel 214 then to the light elements 220, as well as to the cables 212 suspending the downstream panel 214 from the first panel 214.

Likewise, the electrical device of the downstream panel 214 and its light elements 220 are supplied with electrical power, and the electrical power passes through the hammers 218 inserted in the clamps 228 of that downstream panel 214 until reaching the panel 214 suspended from it. The electrical power thus goes from the source 216 to the panels 214 of the unit 210 by using the cables 212 suspending the panels from one another.

In practice, the cables 212 and the electrical devices of the panels 214 define at least two transit paths for the electrical power, such that the latter is both conveyed to the panels 214 from the source 216, and discharged from the panels 214 toward the source 216.

Furthermore, the incline of the panels 214 relative to the vertical can be modified as follows.

Preferably, for each panel 214 having an upstream panel 214, the two cables 212 being inserted into the upper clamps 228 of the panel 214 have the same length, which results in preventing lateral tilting of said panel, which would make it awkward to read.

Inasmuch as the two cables 212 suspending the first panel 212 from the support 217 have the same length, the height of the upper clamps 228 of the first panel 214 is determined by the length $l_2$ of cable 212 between the upper clamps 228 and the support 217, which also determines the value of the angles θ between the plane of the panel 214 and each of the cables 212 in question.

By shortening the length $l_1$ of the cable 212 between the upper clamps 228 of the first panel 214 and the support 217, for example by manually sliding the cables 212 around the support 217, the height of the upper clamps 228 is increased and the height of the lower clamps 228 are simultaneously decreased downward, which tends to align the panel 214 with the vertical.

During this movement of the first panel 214, the two ends of the two cables 212 slide in their respective bowed slots 238, such that the incline of the first panel 214 relative to the two cables 212 suspending it from the support 217 is modified.

Inasmuch as all of the cables 212 of the unit 210 have fixed lengths, this tendency toward alignment of the first panel 212 with the vertical propagates from panel 214 to panel 214. When the length $l_1$ is shortened, the clamps 228 of the different panels 214 that are situated substantially overhanging the upper clamps 228 of the first panel 214 are simultaneously pulled upward, and the lower clamps 228 downward.

It should be noted that based on the length of the cables 212 connecting a given panel to the upstream panel 214, a clamp 228 of a given panel 214 situated overhanging an upper clamp 228 of the upstream panel 214 can correspond to a lower clamp 228 for said panel 214.

This results in a simultaneous modification of the incline of all of the panels 214 relative to the vertical.

The incline of the panels 214 of the unit 210 can then be modified simultaneously via the selection of the length $l_1$ of the portion of the cables 212 situated between the upper clamp 228 in which they are engaged and the support 217 and suspending the first panel 214 from the support 217, any modification of the incline of a given panel leading to the relative movement of the four cables suspending it from the upstream panel 214 in the corresponding bowed slots 238. As a result, the cables 212 of the unit 210 remain positioned substantially vertically under the effect of the weight of the downstream panels 214 when the incline of the panels 214 is modified.

The incline of one panel 214 relative to another panel 214 can be modified via the selection of the length of the four cables 212 suspending the downstream panel 214 from the upstream panel 214 from among those two panels 214.

By extending or decreasing the length of the two cables 212 inserted into the lower or upper clamps 228 suspending a given panel 214 from the upstream panel 214, the height of the corresponding clamps 228 is decreased, which, all other things being equal, tends to align the panel 214 with the vertical without the incline of the upstream panel 214 being modified. Preferably, when the length of a cable 212 suspending a panel 214 from the upstream panel 214 is modified, the length of the cable 212 inserted into the clamp 228 across from it in the opposite edge 230 is also modified, such that the panel 214 does not tilt laterally.

Advantageously, the lengths of the four cables 212 suspending one panel 214 from another are equal, as a result of which the two panels 214 remain parallel to each other when the length $l_1$ is modified, i.e., the incline of all of the panels 214 relative to the vertical is modified.

As previously indicated, due to the fact that the link 240 between a clamp 228 and the given cable 212 is a pivot link, the relative rotation of the clamp 228 with respect to the cable is allowed.

The rotation of the panel 214 to which the clamps 228 are connected relative to the vertical is thus made possible.

The simple structure of these links 240—and in particular the locking of the relative movement of the hammers 218 with respect to the clamps 228 and therefore the cables 212 with respect to the panels 214—then allows a simultaneous adaptation of the incline of all of the panels 214 whereof the links 240 are pivot links by modifying only the arrangement of the cables 214 suspending the first panel 214 from the unit 210.

Furthermore, the relative incline between two panels 214 is adaptable for replacing the cables 212 connecting one to the other using cables 212 with a different length, which does not require any tool to be done.

Alternatively, the unit 210 only comprises a single panel 214.

Alternatively, the unit 210 comprises more than two panels, for example three panels, or comprises a significant number of panels, for example a number of panels greater than four.

Alternatively, the first panel 214 is fastened to the support by four independent cables 212 connected to the support, instead of two cables 212 wound around said support 217. Furthermore, the support 217 comprises winding means (not shown) for winding four cables 214 around the support 217 in order to modify the length of those four cables between their respective clamps 228 on the first panel 214 and the support 217.

The winding means thus make it possible to modify the incline of the panels 214 of the unit without having to slide the cables manually around the support 217.

Figure 17:
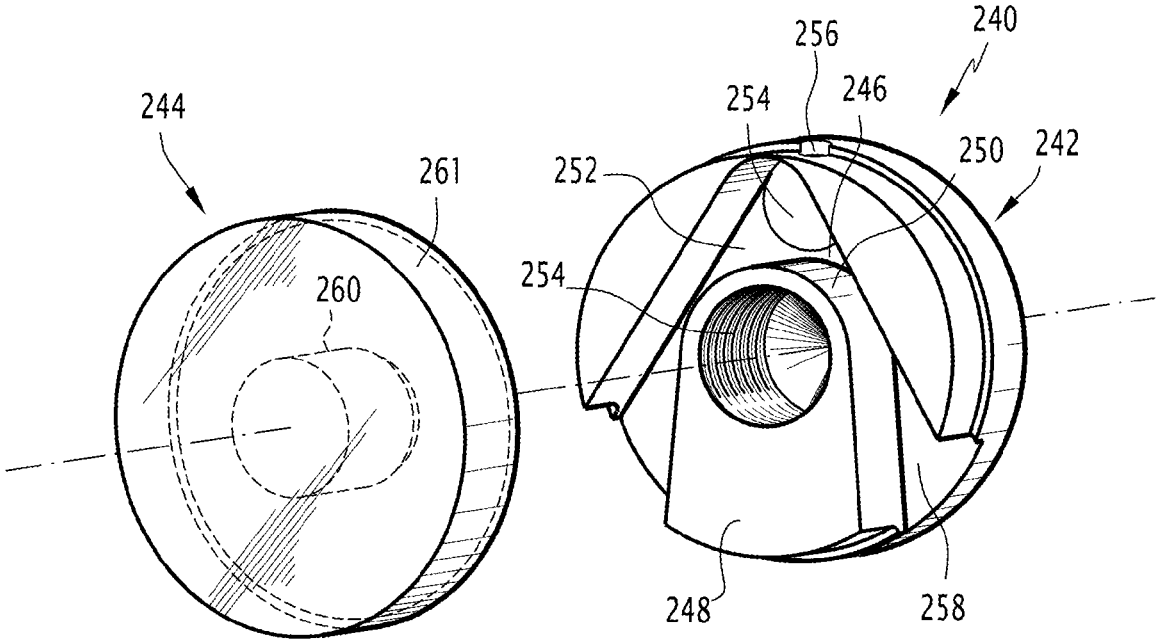
FIG. 17 is a diagrammatic illustration of a pulley of a display unit according to the alternative of the invention.
Figure 18:
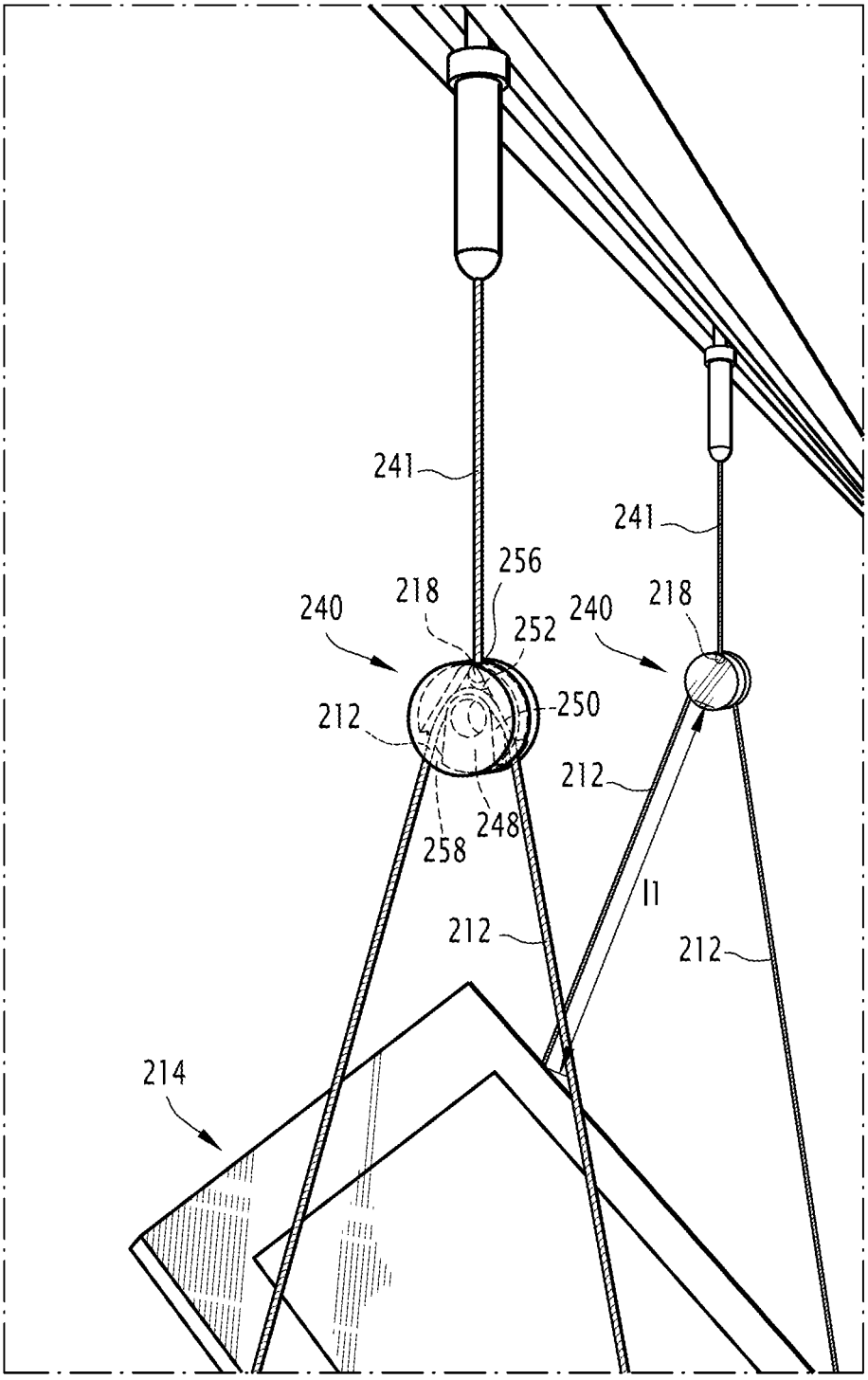
FIG. 18 is a diagrammatic illustration of a display unit provided with pulleys illustrated in FIG. 17.

Alternatively, in reference to FIGS. 17 and 18, the unit 210 comprises two pulleys 240 for suspending the first panel 214 from the support 217, as well as two electrically conductive cables 241 each bearing a hammer 218 at one of their ends.

In reference to FIG. 17, each pulley 240 comprises a base 242 and a stopper 244.

The base 242 has a generally cylindrical shape and has, over part of its thickness, a recess 246 with a generally triangular shape in which a tongue 248 is formed.

The recess 246 has a rounded apex 252 situated near the periphery of the base 242. A hemispherical depression 254 for receiving a hammer 218 is formed in the surface of the base 242 at the apex 252. An orifice 256 is positioned aligned with the apex 252 and is intended for the passage of the cable 241 supporting the hammer 218.

The tongue 248 has a rounded apex 250 and delimits a U-shaped slot 258 in the recess 248. The tongue 248 has a cylindrical notch 254 situated substantially at the center of the base 242.

The stopper 244 has a shape complementary to that of the base 242 and comprises a post 260 in its middle designed to be engaged in the notch 254 to close off the pulley 240, as well as a rim 261.

The base 242 and the stopper 244 of the pulleys 240 are for example made from aluminum, copper or stainless steel by machining or molding.

In reference to FIG. 18, during operation of the unit 210 according to this alternative, each pulley 240 is suspended from the support 217 using a cable 241 engaged passed in the orifice 256 of the corresponding pulley 240, and therefore the hammer 218 is received in the hemispherical depression 254. The hammer 218 abuts against the surface delimited by the recess 248 in the vicinity of the orifice 256, such that the relative position of the cable 241 and the pulley 240 is fixed.

The cables 241 are then connected to the support 217 at their end with no hammer 218, for example using the device as described in document FR 2,945,385 Al.

The two cables 212 of the first panel 214 are respectively engaged in the slot 258 of one of the pulleys 240, and cooperate abutting with the apex 250 of the corresponding tongue 248.

The rim 261 of the stopper 240 for each pulley 240 presses the corresponding cable 212 against the surface of the recess 246 to immobilize the sliding of the cable 212 in the slot 258, such that the incline of the first panel 214, and therefore of the panels of the unit 210, is fixed when the stopper 244 closes off the pulley 240.

In order to modify the incline of the panels 214, the stopper 244 is removed from the two pulleys 240, and the cables 212 of the first panel 214 are slid in the corresponding slot 258 so as to modify the length $l_1$, for example by moving the lower or upper part of the panel 214.

This alternative according to the invention makes it possible to avoid any wear of the support 217 related to the cooperation and sliding of the cables 212 around the support 217.

Furthermore, the cooperation of the stopper 244 with the base 242 in the closed of position of the pulley 240 results in preventing any sliding of the cables 212 of the first panel 214 in the pulleys 240, and thus preventing any untimely modification of the incline of the panels 214 of the unit 210.

The present invention, therefore, is well adapted to carry out the objects and attain the ends and advantages mentioned, as well as others inherent therein. While the invention has been depicted and described and is defined by reference to particular preferred embodiments of the invention, such references do not imply a limitation on the invention, and no such limitation is to be inferred. The invention is capable of considerable modification, alteration and equivalents in form and function, as will occur to those ordinary skilled in the pertinent arts. The depicted and described preferred embodiments of the invention are exemplary only and are not exhaustive of the scope of the invention. Consequently, the invention is intended to be limited only by the spirit and scope of the appended claims, giving full cognizance to equivalents in all respects.

The invention claimed is:

1. An illuminated display unit comprising:

at least one electrically conductive cable, at least two display panels connected to one another via said at least one cable, each display panel including light elements, and an electrical power source which supplies electrical power to the light elements of said at least two display panels and which is located upstream from the display panels, two consecutive display panels defining an upstream display panel and a downstream display panel relative to the electrical power source, each display panel including a transmission device for transmitting electrical power through said panel, such that the downstream display panel is electrically connected to the electrical power source via the transmission device of the upstream display panel, wherein each display panel comprises at least two electrically conductive clamps respectively capable of locking the at least one cable to said display panel and respectively situated on one of the two opposite edges of the display panel.

2. The unit according to claim 1, wherein the transmission device of each display panel comprises an electrically conductive track extending between the two clamps through which the electrical energy passes from one of said clamps to the other.

3. The unit according to claim 1 wherein said illuminated display unit is arranged vertically, each display panel being suspended from the upstream display panel using only one cable, the weight of a given display panel being supported by the upstream display panel.

4. The unit according to claim 3, wherein at least two display panels suspended from one another each having a substantially rectangular general shape, said two display panels having respective widths different from one another.

5. The unit according to claim 1 wherein each cable comprises two electrically conductive hammers respectively supported by one of the two ends of said cable.

6. The unit according to claim 5, wherein the display unit comprises at least one electrically conductive clamp, each clamp comprising a closed housing and a slot for inserting a hammer into the housing.

7. The unit according to claim 6, wherein each hammer has an ovoid shape having a single axis of symmetry of revolution and in that each slot has a portion having dimensions substantially equal to those of the maximum section of said hammer along its axis of symmetry of revolution.

8. The unit according to claim 1, wherein it comprises at least two upstream display panels and at least one downstream display panel, the downstream display panel being connected to each of the two upstream display panels by at least one cable, the downstream display panel being electrically connected to the electrical power source via the transmission devices of the two upstream display panels.

9. The unit according to claim 8, wherein the electrical power source has a positive polarity terminal and a negative polarity terminal, the downstream display panel being electrically connected to the positive polarity terminal of the electrical power source via the transmission device of one of the two upstream display panels, and being electrically connected to the negative polarity terminal of the electrical power source via the transmission device of the other of the two upstream panels.

10. The unit according to claim 1, wherein it comprises at least one upstream display panel and at least two downstream display panels, each downstream display panel being connected to the upstream display panel by at least one cable, the downstream display panels being electrically connected to the electrical power source via the transmission device of the upstream display panel.

11. The unit according to claim 1, wherein each display panel comprises a section, and at least one electrically conductive clamp having an outer face in which a slot for receiving one of the at least one cable is formed, at least one of the clamps of one of the at least one display panel is housed in said display panel, the outer face of the clamp being substantially aligned with the section of the display panel, the slot being oriented toward the outside of the display panel and being accessible from the outside of the display panel.

12. The unit according to claim 11, wherein each clamp of each display panel is housed in the corresponding display panel, the outer face of each clamp being substantially aligned with the section of the corresponding display panel, the slot being oriented toward the outside of the display panel and being accessible from the outside of the display panel.

13. The unit according to claim 12, wherein the or each display panel has a substantially rectangular shape, each display panel comprising eight clamps incorporated into the display panel and positioned in the display panel at a rate of two clamps per edge.

14. The unit according to claim 13, wherein it comprises at least one display panel in which the distances separating two clamps of a given edge are substantially equal to one another, preferably all equal to one another.

15. The unit according to claim 11, wherein the or at least one of the clamps housed in the corresponding display panel has two oblique faces inclined relative to the outer face of the corresponding clamp and is received in a receiving housing with a complementary shape in the corresponding display panel, wherein vectors $(\vec{m}, \vec{n})$ respectively normal to each of the oblique faces of said clamp are oriented toward the outside of the display panel, the clamp being immobilized in its housing by abutting cooperation of its oblique faces with inclined surfaces delimiting said housing.

16. The unit according to claim 11, wherein each cable comprises two hammers respectively situated at both of the ends of said cable and capable of being inserted into the slots, each clamp comprising a central housing on which the corresponding slot emerges, the central housing being delimited toward the outer face by a bottom delimiting a concavity with a shape complementary to that of said hammers.

17. The unit according to claim 16, wherein the slot comprises a circular portion emerging in the central housing, as well as a rectilinear longitudinal portion emerging in the circular portion, in the central housing and in the concavity.

18. The unit according to claim 17, wherein each hammer has an ovoid shape having a single axis of symmetry of revolution with a maximum section taken along said axis of symmetry of revolution substantially equal to the diameter of the circular portion, in that each clamp comprises a guide surface arranged in the central housing and connecting the circular portion of the slot to the concavity, and in that said guide surface has a convex shape oriented toward the central housing, such that the movement of a hammer along said guide surface causes pivoting of the axis of symmetry of revolution of the hammer.

19. The unit according to claim 11 wherein each panel has a generally rectangular shape and comprises a central plate and a front plate with substantially the same dimensions, and in that at least one of the display panels comprises irreversible securing means that irreversibly secure two consecutive edges of the front plate to the two corresponding edges of the central plate, and reversible securing means that reversibly secure the other two edges of the front plate to the corresponding two edges of the central plate.

20. The unit according to claim 19, wherein the reversible securing means comprise magnets at least supported by the front plate and the central plate at their edges, and in that the irreversible securing means comprise adhesive strips supported at least by the front plate or the central plate along the corresponding edges.

21. The unit according to claim 11, wherein at least one clamp comprises at least one lug secured to the clamp and extending from the clamp in a direction opposite the clamp.

* * * * *